US008423371B2

(12) United States Patent
Yamanashi et al.

(10) Patent No.: US 8,423,371 B2
(45) **Date of Patent: *Apr. 16, 2013**

(54) AUDIO ENCODER, DECODER, AND ENCODING METHOD THEREOF

(75) Inventors: Tomofumi Yamanashi, Kanagawa (JP); Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 383 days.

This patent is subject to a terminal disclaimer.

(21) Appl. No.: 12/809,150

(22) PCT Filed: Dec. 22, 2008

(86) PCT No.: PCT/JP2008/003894

§ 371 (c)(1),
(2), (4) Date: Jun. 18, 2010

(87) PCT Pub. No.: WO2009/081568

PCT Pub. Date: Jul. 2, 2009

(65) Prior Publication Data

US 2010/0274558 A1 Oct. 28, 2010

(30) Foreign Application Priority Data

Dec. 21, 2007 (JP) ..... 2007-330838
May 16, 2008 (JP) ..... 2008-129710

(51) Int. Cl.
*G10L 19/00* (2006.01)
*G10L 11/04* (2006.01)
*G10L 19/02* (2006.01)

(52) U.S. Cl.
USPC ..... 704/500; 704/501; 704/502; 704/503; 704/504; 704/207; 704/219; 704/220; 704/229; 704/230

(58) Field of Classification Search ..... 704/500–504, 704/207, 219, 220
See application file for complete search history.

(56) References Cited

U.S. PATENT DOCUMENTS 5,682,407 A * 10/1997 Funaki ..... 375/240
5,737,484 A * 4/1998 Ozawa ..... 704/219

(Continued)

FOREIGN PATENT DOCUMENTS

EP 1677088 A1 * 7/2006
JP 6-85607 3/1994

(Continued)

OTHER PUBLICATIONS

Xiaopeng Hu; Guiming He; Xiaoping Zhou; , "An efficient low complexity encoder for MPEG advanced audio coding," Advanced Communication Technology, 2006. ICACT 2006. The 8th International Conference, vol. 3, no., pp. 5-1505, Feb. 20-22, 2006.*

(Continued)

*Primary Examiner* — Paras D Shah
(74) *Attorney, Agent, or Firm* — Greenblum & Bernstein, P.L.C.

(57) ABSTRACT

An encoder capable of reducing the degradation of the quality of the decoded signal in the case of band expansion in which the high band of the spectrum of an input signal is estimated from the low band. In this encoder, a first layer encoder encodes an input signal and generates first encoded information, a first layer decoder decodes the first encoded information and generates a first decoded signal, a characteristic judger analyzes the intensity of the harmonic structure of the input signal and generates harmonic characteristic information representing the analysis result, and a second layer encoder changes, on the basis of the harmonic characteristic information, the numbers of bits allocated to parameters included in second encoded information created by encoding the difference between the input signal and the first decoded signal before creating the second information.

14 Claims, 15 Drawing Sheets

U.S. PATENT DOCUMENTS

| | | | | |
|---|---|---|---|---|
| 5,778,335 | A | 7/1998 | Ubale et al. | |
| 5,848,387 | A | 12/1998 | Nishiguchi et al. | |
| 6,006,178 | A * | 12/1999 | Taumi et al. | 704/222 |
| 6,208,957 | B1 | 3/2001 | Nomura | |
| 6,330,534 | B1 * | 12/2001 | Yasunaga et al. | 704/223 |
| 6,629,070 | B1 * | 9/2003 | Nagasaki | 704/233 |
| 6,680,972 | B1 | 1/2004 | Liljeryd et al. | |
| 6,687,666 | B2 * | 2/2004 | Ehara et al. | 704/207 |
| 6,915,257 | B2 * | 7/2005 | Heikkinen et al. | 704/214 |
| 7,006,966 | B2 * | 2/2006 | Yamaura et al. | 704/219 |
| 7,177,804 | B2 * | 2/2007 | Wang et al. | 704/219 |
| 7,469,206 | B2 | 12/2008 | Kjorling et al. | |
| 7,587,316 | B2 * | 9/2009 | Morii | 704/226 |
| 7,599,833 | B2 * | 10/2009 | Sung et al. | 704/219 |
| 7,702,504 | B2 * | 4/2010 | Son et al. | 704/219 |
| 7,873,510 | B2 * | 1/2011 | Kurniawati et al. | 704/200.1 |
| 7,895,034 | B2 * | 2/2011 | You | 704/200.1 |
| 2004/0002856 | A1 * | 1/2004 | Bhaskar et al. | 704/219 |
| 2004/0028244 | A1 | 2/2004 | Tsushima et al. | |
| 2005/0055203 | A1 * | 3/2005 | Makinen et al. | 704/229 |
| 2005/0096898 | A1 * | 5/2005 | Singhal | 704/205 |
| 2005/0096917 | A1 | 5/2005 | Kjorling et al. | |
| 2005/0163323 | A1 * | 7/2005 | Oshikiri | 381/22 |
| 2006/0173677 | A1 * | 8/2006 | Sato et al. | 704/223 |
| 2007/0071116 | A1 | 3/2007 | Oshikiri | |
| 2007/0271102 | A1 | 11/2007 | Morii | |
| 2008/0033717 | A1 | 2/2008 | Sato et al. | |
| 2009/0132261 | A1 | 5/2009 | Kjorling et al. | |
| 2009/0326929 | A1 | 12/2009 | Kjorling et al. | |
| 2010/0161323 | A1 | 6/2010 | Oshikiri | |

FOREIGN PATENT DOCUMENTS

| | | |
|---|---|---|
| JP | 8-123495 | 5/1996 |
| JP | 9-127989 | 5/1997 |
| JP | 11-30997 | 2/1999 |
| JP | 2001-521648 | 11/2001 |
| JP | 2003-108197 | 4/2003 |
| JP | 2004-348120 | 12/2004 |
| JP | 2006-72026 | 3/2006 |
| WO | 98/57436 | 12/1998 |
| WO | 03/046891 | 6/2003 |
| WO | 2005/040749 | 5/2005 |

OTHER PUBLICATIONS

Marina Bosi, "Audio coding: Basic Principles and recent developments", 6th international conference on humans and computers, Aug. 28, 2003, URL: http://www.mp3-tech.org/programmer/docs/Bosi.pdf.

Ramprashad S A, "A two stage hybrid embedded speech/audio coding structure ", Acoustics, Speech and Signal Processing, 1998. Proceedings of the 1998 IEEE International Conference on Seattle, WA, USA May 12-15, 1998, New York, NY, USA, IEEE, US, vol. 1., pp. 337-340.

Search report from E.P.O., mail date is Dec. 16, 2010.

Tomofumi Yamanashi et al., "Encoding Device, Decoding Device, and Method Thereof", U.S. Appl. No. 12/808,505, filed Jun. 2010, PP.

* cited by examiner

AUDIO ENCODER, DECODER, AND ENCODING METHOD THEREOF

TECHNICAL FIELD

The present invention relates to an encoding apparatus, decoding apparatus and encoding method used in a communication system that encodes and transmits signals.

BACKGROUND ART

Upon transmitting speech/audio signals in, for example, a packet communication system represented by Internet communication and mobile communication system, compression/coding techniques are often used to improve the efficiency of transmission of speech/audio signals (i.e. music signals). Also, recently, there is a growing need for techniques of simply encoding speech/audio signals at a low bit rate and encoding speech/audio signals of a wider band.

To meet this need, there is a technique for encoding signals of a wide frequency band at a low bit rate (e.g. see Patent Document 1). According to this technique, the overall bit rate is reduced by dividing an input signal into the lower-band signal and the higher-band signal and by encoding the input spectrum replacing the spectrum of the higher-band signal with the spectrum of the lower-band signal.

Patent Document 1: Japanese Translation of PCT Application Laid-Open No. 2001-521648

DISCLOSURE OF INVENTION

Problems to be Solved by the Invention

However, the band expansion technique disclosed in Patent Document 1 does not take into account the harmonic structure in the lower band of an input signal spectrum or the harmonic structure in the lower band of a decoded spectrum. For example, with the above band expansion technique, band expansion processing is performed without identifying whether an input signal is an audio signal or a speech signal. However, generally, compared to an audio signal, a speech signal is likely to have an unstable harmonic structure and a spectral envelope of a complicated shape.

Therefore, if an equal number of bits to the number of bits allocated to the spectral envelope of an audio signal is allocated to the spectral envelope of a speech signal to expand the band, coding quality degrades, and, as a result, the sound quality of decoded signals may degrade. Also, by contrast, in a case where the harmonic structure of an input signal is very stable like an audio signal, an especially large number of bits need to be allocated to represent the harmonic structure. In short, to improve the sound quality of decoded signals, it is necessary to switch specific processing for band expansion according to the stability of the harmonic structure.

FIG. 1 shows spectral characteristics of two input signals between which a spectral characteristic varies significantly. In FIG. 1, the horizontal axis represents frequency and the vertical axis represents spectral amplitude. FIG. 1A shows a spectrum of very stable periodicity, while FIG. 1B shows a spectrum of very unstable periodicity. Although Patent Document 1 does not specifically disclose selection criteria as to which band in the lower-band spectrum is used to generate the higher-band spectrum, the method of searching for the most similar part to the higher-band spectrum from the lower-band spectrum in each frame, is considered to be the most common method. In this case, with a conventional method, upon generating the higher-band spectrum by a band expansion technique, band expansion processing is performed in the same scheme (e.g. the same similarity search method or the same spectrum envelope quantization method), without identifying the spectrum of a reference input signal. However, the spectrum in FIG. 1A has very stable periodicity compared to the spectrum in FIG. 1B, and, consequently, upon performing band expansion using the spectrum in FIG. 1A, the sound quality of a decoded signal degrades severely unless the positions of peaks and valleys of the higher-band spectrum are encoded adequately. That is, in this case, it is necessary to increase the amount of information as to which band in the lower-band spectrum is used to generate the higher-band spectrum. By contrast, upon performing band expansion using the spectrum in FIG. 1B, the harmonic structure of the spectrum is not so important and does not have a significant influence on the sound quality of a decoded signal. Conventionally, there is a problem that band expansion with one common method is applied even to input signals having significantly different spectral characteristics, and therefore it is not possible to provide a decoded signal of sufficiently-high quality.

It is therefore an object of the present invention to provide an encoding apparatus, decoding apparatus and encoding method for suppressing the quality degradation of decoded signals due to band expansion by performing band expansion taking into account the harmonic structure in the lower band of an input signal spectrum or the harmonic structure in the lower band of a decoded spectrum.

Means for Solving the Problem

The encoding apparatus of the present invention employs a configuration having: a first encoding section that encodes an input signal and generates first encoded information; a decoding section that decodes the first encoded information and generates a decoded signal; a characteristic deciding section that analyzes a stability of a harmonic structure of the input signal and generates harmonic characteristic information showing an analysis result; and a second encoding section that generates second encoded information by encoding a difference of the decoded signal with respect to the input signal, and, based on the harmonic characteristic information, changes a number of bits to allocate to a plurality of parameters forming the second encoded information.

The decoding apparatus of the present invention employs a configuration having: a receiving section that receives first encoded information acquired by encoding an input signal in an encoding apparatus, second encoded information acquired by encoding a difference between the input signal and a decoded signal decoding the first encoded information, and harmonic characteristic information generated based on an analysis result of analyzing a stability of a harmonic structure of the input signal; a first decoding section that decodes a first layer using the first encoded information and acquires a first decoded signal; and a second decoding section that decodes a second layer using the second encoded information and the first decoded signal, and acquires a second decoded signal, where the second decoding section decodes the second layer using a plurality of parameters which form the second encoded information and to which a number of bits is allocated based on the harmonic characteristic information in the encoding apparatus.

The encoding method of the present invention includes: a first encoding step of encoding an input signal and generating first encoded information; a decoding step of decoding the first encoded information and generating a decoded signal; a characteristic deciding step of analyzing a stability of a harmonic structure of the input signal and generating harmonic characteristic information showing an analysis result; and a second encoding step of generating second encoded information by encoding a difference of the decoded signal with respect to the input signal, and, based on the harmonic characteristic information, changing a number of bits to allocate to a plurality of parameters forming the second encoded information.

Advantageous Effect of the Invention

According to the present invention, it is possible to provide decoded signals of high quality from various input signals having significantly different harmonic structures.

BEST MODE FOR CARRYING OUT THE INVENTION

An example of an outline of the present invention is that, in a case where the difference in the harmonic structure between the higher band of an input signal and one of the lower band of a decoded signal spectrum and the lower band of the input signal is taken into account, and where this difference is equal to or greater than a predetermined level, it is possible to provide decoded signals of high quality from various input signals having significantly different harmonic structures, by switching the method of encoding spectral data of the higher band of a wideband signal based on spectral data of the lower band of the wideband signal (i.e. band expansion method).

Embodiments of the present invention will be explained below in detail with reference to the accompanying drawings. Also, the encoding apparatus and decoding apparatus according to the present invention will be explained using a speech encoding apparatus and speech decoding apparatus as an example.

Embodiment 1

Figure 1B:
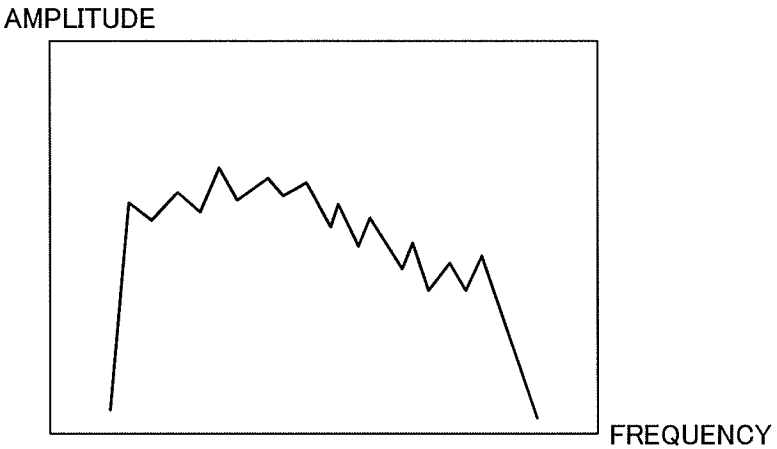
FIG. 1 shows spectral characteristics in a conventional band expansion technique.
Figure 1A:
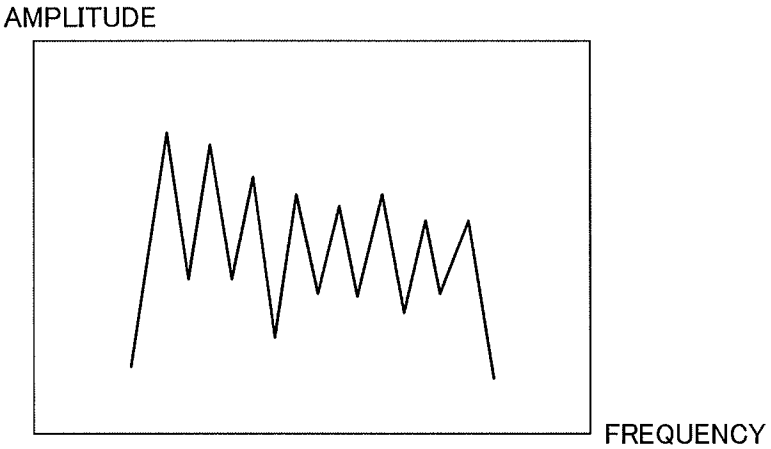
Figure 2:
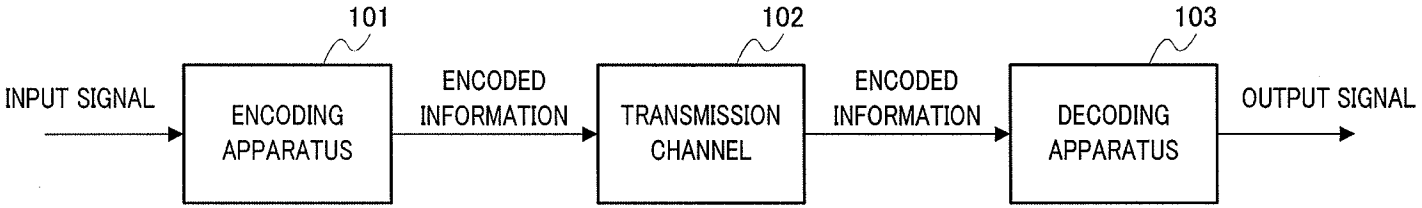
FIG. 2 is a block diagram showing the configuration of a communication system including an encoding apparatus and decoding apparatus according to Embodiment 1 of the present invention.

FIG. 2 is a block diagram showing the configuration of a communication system including an encoding apparatus and decoding apparatus according to Embodiment 1 of the present invention. In FIG. 2, the communication system provides an encoding apparatus and decoding apparatus, which can communicate with each other via a propagation path.

Encoding apparatus 101 divides an input signal every N samples (where N is a natural number) and performs coding per frame comprised of N samples. In this case, an input signal to be encoded is represented by $x_n$ (n=0, . . . , N−1). Here, n represents the (n+1)-th signal element of the input signal divided every N samples. Encoded input information (i.e. encoded information) is transmitted to decoding apparatus 103 via transmission channel 102.

Decoding apparatus 103 receives and decodes the encoded information transmitted from encoding apparatus 101 via transmission channel 102, and provides an output signal.

Figure 3:
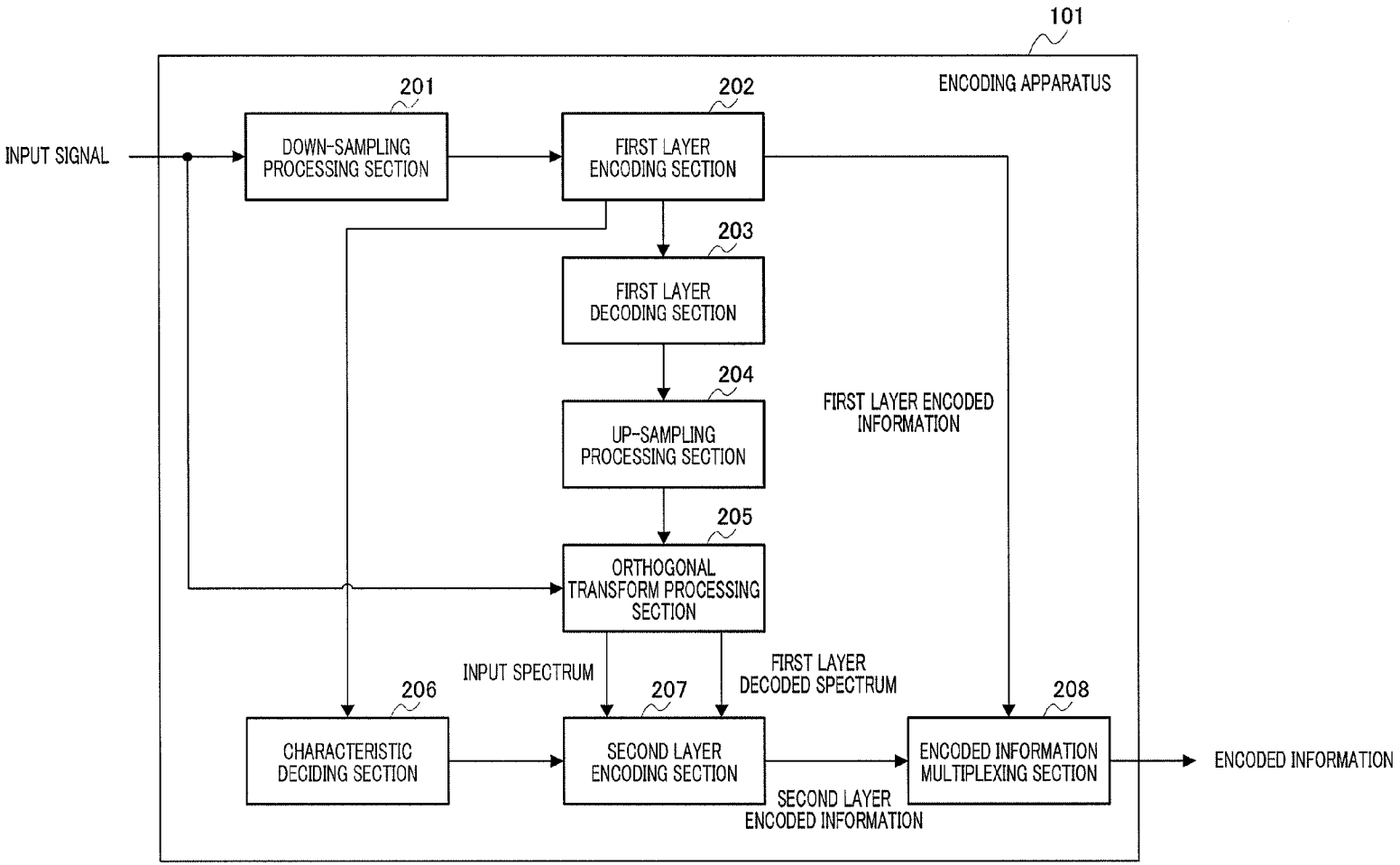
FIG. 3 is a block diagram showing the main components inside an encoding apparatus shown in FIG. 2.

FIG. 3 is a block diagram showing the main components inside encoding apparatus 101 shown in FIG. 2.

When the sampling frequency of an input signal is $SR_{input}$, down-sampling processing section 201 down-samples the sampling frequency of the input signal from $SR_{input}$ to $SR_{base}$ ($SR_{base}<SR_{input}$), and outputs the down-sampled input signal to first layer encoding section 202 as a down-sampled input signal.

First layer encoding section 202 encodes the down-sampled input signal received as input from down-sampling processing section 201 using, for example, a CELP (Code Excited Linear Prediction) type speech encoding method, and generates first layer encoded information. Further, first layer encoding section 202 outputs the generated first layer encoded information to first layer decoding section 203 and encoded information multiplexing section 208, and outputs the quantization adaptive excitation gain included in the first layer encoded information to characteristic deciding section 206.

First layer decoding section 203 decodes the first layer encoded information received as input from first layer encoding section 202 using, for example, a CELP type speech decoding method, to generate a first layer decoded signal, and outputs the generated first layer decoded signal to up-sampling processing section 204. Also, first layer decoding section 203 will be described later in detail.

Up-sampling processing section 204 up-samples the sampling frequency of the first layer decoded signal received as input from first layer decoding section 203 from $SR_{base}$ to $SR_{input}$, and outputs the up-sampled first layer decoded signal to orthogonal transform processing section 205 as an up-sampled first layer decoded signal.

Orthogonal transform processing section 205 incorporates buffers buf $\mathbf{1}_n$ and buf $\mathbf{2}_n$ (n=0, . . . , N−1) and applies the modified discrete cosine transform ("MDCT") to input signal $x_n$ and up-sampled first layer decoded signal $y_n$ received as input from up-sampling processing section 204.

Next, as for the orthogonal transform processing in orthogonal transform processing section 205, the calculation steps and data output to the internal buffers will be explained.

First, orthogonal transform processing section 205 initializes the buffers buf $\mathbf{1}_n$ and buf $\mathbf{2}_n$ using 0 as the initial value according to equation 1 and equation 2.

[1]

$$buf1_n=0\ (n=0, \ldots, N-1) \quad \text{(Equation 1)}$$

[2]

$$buf2_n=0\ (n=0, \ldots, N-1) \quad \text{(Equation 2)}$$

Next, orthogonal transform processing section 205 applies the MDCT to input signal $x_n$ and up-sampled first layer decoded signal $y_n$ according to following equations 3 and 4, and calculates MDCT coefficients S2($k$) of the input signal (hereinafter "input spectrum") and MDCT coefficients S1($k$) of up-sampled first layer decoded signal $y_n$ (hereinafter "first layer decoded spectrum").

[3]

$$S2(k) = \frac{2}{N}\sum_{n=0}^{2N-1} x'_n \cos\left[\frac{(2n+1+N)(2k+1)\pi}{4N}\right] \quad \text{(Equation 3)}$$

$$(k = 0, \ldots, N-1)$$

[4]

$$S1(k) = \frac{2}{N}\sum_{n=0}^{2N-1} y'_n \cos\left[\frac{(2n+1+N)(2k+1)\pi}{4N}\right] \quad \text{(Equation 4)}$$

$$(k = 0, \ldots, N-1)$$

Here, k is the index of each sample in a frame. Orthogonal transform processing section 205 calculates $x_n'$, which is a vector combining input signal $x_n$, and buffer buf $\mathbf{1}_n$, according to following equation 5. Further, orthogonal transform processing section 205 calculates $y_n'$, which is a vector combining up-sampled first layer decoded signal $y_n$ and buffer buf $\mathbf{2}_n$, according to following equation 6.

[5]

$$x'_n = \begin{cases} buf1_n & (n = 0, \ldots N-1) \\ x_{n-N} & (n = N, \ldots 2N-1) \end{cases} \quad \text{(Equation 5)}$$

[6]

$$y'_n = \begin{cases} buf2_n & (n = 0, \ldots N-1) \\ y_{n-N} & (n = N, \ldots 2N-1) \end{cases} \quad \text{(Equation 6)}$$

Next, orthogonal transform processing section 205 updates buffers buf $\mathbf{1}_n$ and buf $\mathbf{2}_n$ according to equation 7 and equation 8.

[7]

$$buf1_n=x_n\ (n=0, \ldots, N-1) \quad \text{(Equation 7)}$$

[8]

$$buf2_n=y_n\ (n=0, \ldots, N-1) \quad \text{(Equation 8)}$$

Further, orthogonal transform processing section 205 outputs input spectrum S2($k$) and first layer decoded spectrum S1($k$) to second layer encoding section 207.

Characteristic deciding section 206 generates characteristic information according to the value of the quantization adaptive excitation gain included in the first layer encoded information received as input from first layer encoding section 202, and outputs the characteristic information to second layer encoding section 207. Characteristic deciding section 206 will be described later in detail.

Based on the characteristic information received as input from characteristic deciding section 206, second layer encoding section 207 generates second layer encoded information using input spectrum S2($k$) and first layer decoded spectrum S1($k$) received as input from orthogonal transform processing section 205, and outputs the generated second layer encoded information to encoded information multiplexing section 208. Second layer encoding section 207 will be described later in detail.

Encoded information multiplexing section 208 multiplexes the first layer encoded information received as input from first layer encoding section 202 and the second layer encoded information received as input from second layer encoding section 207, adds, if necessary, a transmission error code and so on, to the multiplexed encoded information, and outputs the result to transmission channel 102 as encoded information.

Figure 4:
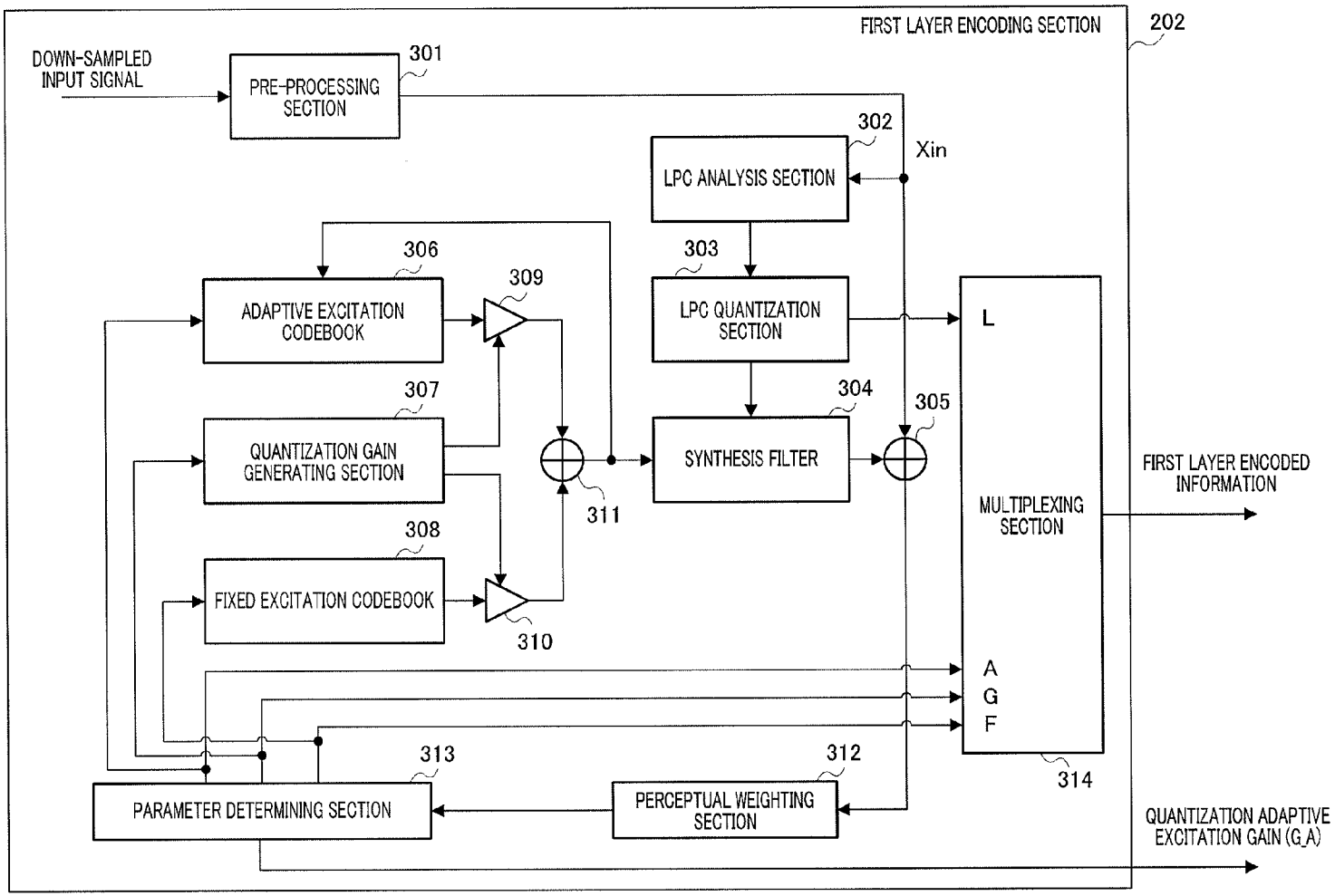
FIG. 4 is a block diagram showing the main components inside a first layer encoding section shown in FIG. 3.

FIG. 4 is a block diagram showing the main components inside first layer encoding section 202.

In FIG. 4, pre-processing section 301 performs high-pass filter processing for removing the DC component, waveform shaping processing or pre-emphasis processing for improving the performance of subsequent encoding processing, on the input signal, and outputs the signal (Xin) subjected to these processings to LPC (Linear Prediction Coefficient) analysis section 302 and adding section 305.

LPC analysis section 302 performs a linear predictive analysis using Xin received as input from pre-processing section 301, and outputs the analysis result (linear predictive analysis coefficient) to LPC quantization section 303.

LPC quantization section 303 performs quantization processing of the linear predictive coefficient (LPC) received as input from LPC analysis section 302, outputs the quantized LPC to synthesis filter 304 and outputs a code (L) representing the quantized LPC to multiplexing section 314.

Synthesis filter 304 generates a synthesized signal by performing a filter synthesis of an excitation received as input from adding section 311 (described later) using a filter coefficient based on the quantized LPC received as input from LPC quantization section 303, and outputs the synthesized signal to adding section 305.

Adding section 305 calculates an error signal by inverting the polarity of the synthesized signal received as input from synthesis filter 304 and adding the synthesized signal with an inverse polarity to Xin received as input from pre-processing section 301, and outputs the error signal to perceptual weighting section 312.

Adaptive excitation codebook 306 stores excitations outputted in the past from adding section 311 in a buffer, extracts one frame of samples from a past excitation specified by a signal received as input from parameter determining section 313 (described later) as an adaptive excitation vector, and outputs this vector to multiplying section 309.

Quantization gain generating section 307 outputs a quantization adaptive excitation gain and quantization fixed excitation gain specified by a signal received as input from parameter determining section 313, to multiplying section 309 and multiplying section 310, respectively.

Fixed excitation codebook 308 outputs a pulse excitation vector having a shape specified by a signal received as input from parameter determining section 313, to multiplying section 310 as a fixed excitation vector. Here, a result of multiplying the pulse excitation vector by a spreading vector can be equally outputted to multiplying section 310 as a fixed excitation vector.

Multiplying section 309 multiplies the adaptive excitation vector received as input from adaptive excitation codebook 306 by the quantization adaptive excitation gain received as input from quantization gain generating section 307, and outputs the result to adding section 311. Also, multiplying section 310 multiplies the fixed excitation vector received as input from fixed excitation codebook 308 by the quantization fixed excitation gain received as input from quantization gain generating section 307, and outputs the result to adding section 311.

Adding section 311 adds the adaptive excitation vector multiplied by the gain received as input from multiplying section 309 and the fixed excitation vector multiplied by the gain received as input from multiplying section 310, and outputs the excitation of the addition result to synthesis filter 304 and adaptive excitation codebook 306. The excitation outputted to adaptive excitation codebook 306 is stored in the buffer of adaptive excitation codebook 306.

Perceptual weighting section 312 performs perceptual weighting of the error signal received as input from adding section 305, and outputs the result to parameter determining section 313 as coding distortion.

Parameter determining section 313 selects the adaptive excitation vector, fixed excitation vector and quantization gain that minimize the coding distortion received as input from perceptual weighting section 312, from adaptive excitation codebook 306, fixed excitation codebook 308 and quantization gain generating section 307, respectively, and outputs an adaptive excitation vector code (A), fixed excitation vector code (F) and quantization gain code (G) showing the selection results, to multiplexing section 314. Further, parameter determining section 313 outputs quantization adaptive excitation gain (G_A) included in the quantization gain code (G) to output to multiplexing section 314, to characteristic deciding section 206.

Multiplexing section 314 multiplexes the code (L) showing the quantized LPC received as input from LPC quantization section 303, the adaptive excitation vector code (A), fixed excitation vector code (F) and quantization gain code (G) received as input from parameter determining section 313, and outputs the result to first layer decoding section 203 as first layer encoded information.

Figure 5:
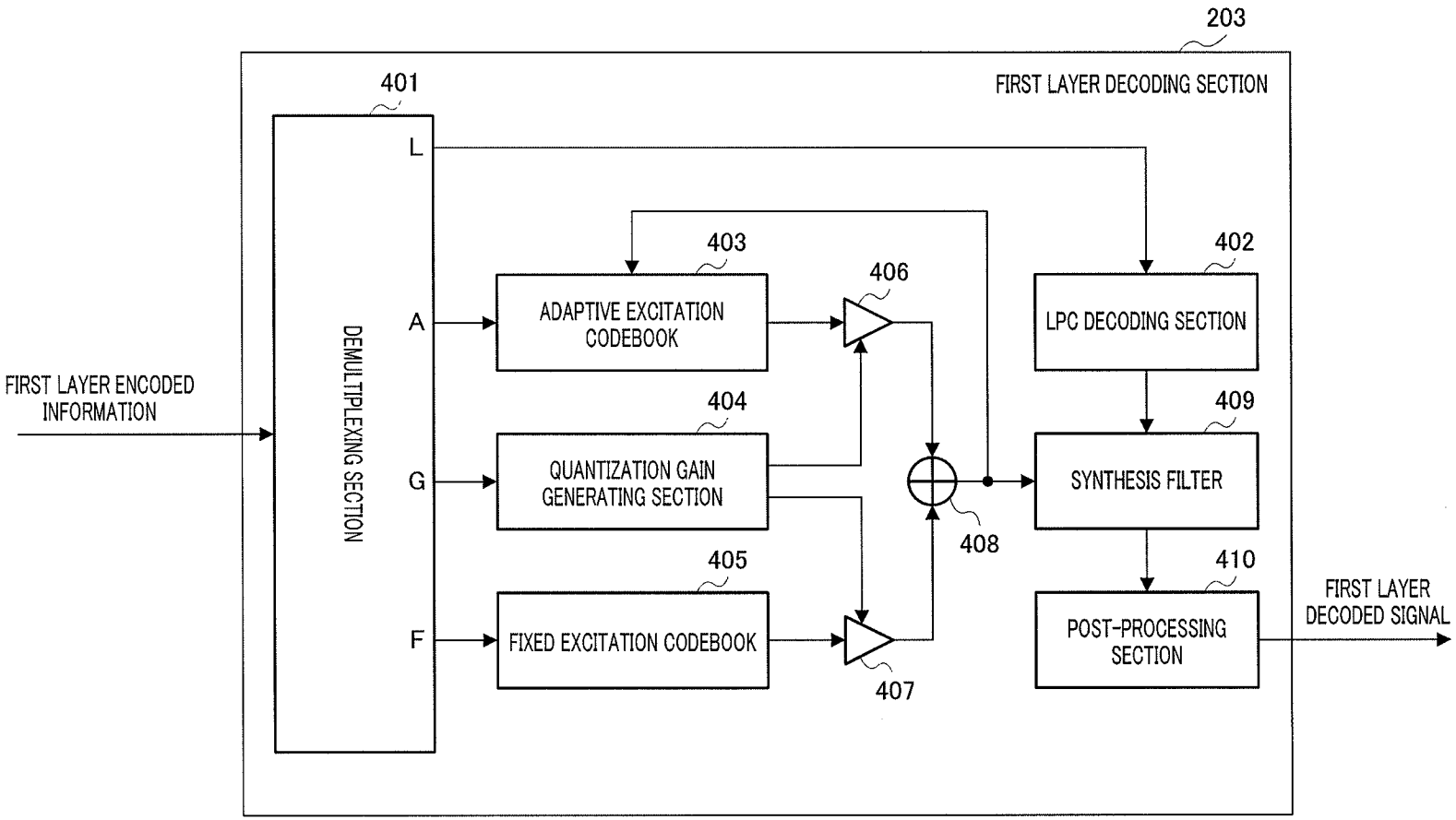
FIG. 5 is a block diagram showing the main components inside a first layer decoding section shown in FIG. 3.

FIG. 5 is a block diagram showing the main components inside first layer decoding section 203.

In FIG. 5, demultiplexing section 401 demultiplexes first layer encoded information received as input from first layer encoding section 202, into individual codes (L), (A), (G) and (F). The separated LPC code (L) is outputted to LPC decoding section 402, the separated adaptive excitation vector code (A) is outputted to adaptive excitation codebook 403, the separated quantization gain code (G) is outputted to quantization gain generating section 404 and the separated fixed excitation vector code (F) is outputted to fixed excitation codebook 405.

LPC decoding section 402 decodes the quantized LPC from the code (L) received as input from demultiplexing section 401, and outputs the decoded quantized LPC to synthesis filter 409.

Adaptive excitation codebook 403 extracts one frame of samples from a past excitation specified by the adaptive excitation vector code (A) received as input from demultiplexing section 401, as an adaptive excitation vector, and outputs the adaptive excitation vector to multiplying section 406.

Quantization gain generating section 404 decodes a quantization adaptive excitation gain and quantization fixed excitation gain specified by the quantization gain code (G) received as input from demultiplexing section 401, outputs the quantization adaptive excitation gain to multiplying section 406 and outputs the quantization fixed excitation gain to multiplying section 407.

Fixed excitation codebook 405 generates a fixed excitation vector specified by the fixed excitation vector code (F) received as input from demultiplexing section 401, and outputs the fixed excitation vector to multiplying section 407.

Multiplying section 406 multiplies the adaptive excitation vector received as input from adaptive excitation codebook 403 by the quantization adaptive excitation gain received as input from quantization gain generating section 404, and outputs the result to adding section 408. Also, multiplying section 407 multiplies the fixed excitation vector received as input from fixed excitation codebook 405 by the quantization fixed excitation gain received as input from quantization gain generating section 404, and outputs the result to adding section 408.

Adding section 408 generates an excitation by adding the adaptive excitation vector multiplied by the gain received as input from multiplying section 406 and the fixed excitation vector multiplied by the gain received as input from multiplying section 407, and outputs the excitation to synthesis filter 409 and adaptive excitation codebook 403.

Synthesis filter 409 performs a filter synthesis of the excitation received as input from adding section 408 using the filter coefficient decoded in LPC decoding section 402, and outputs the synthesized signal to post-processing section 410.

Post-processing section 410 applies processing for improving the subjective quality of speech such as formant emphasis and pitch emphasis and processing for improving the subjective quality of stationary noise, to the signal received as input from synthesis filter 409, and outputs the result to up-sampling processing section 204 as a first layer decoded signal.

Figure 6:
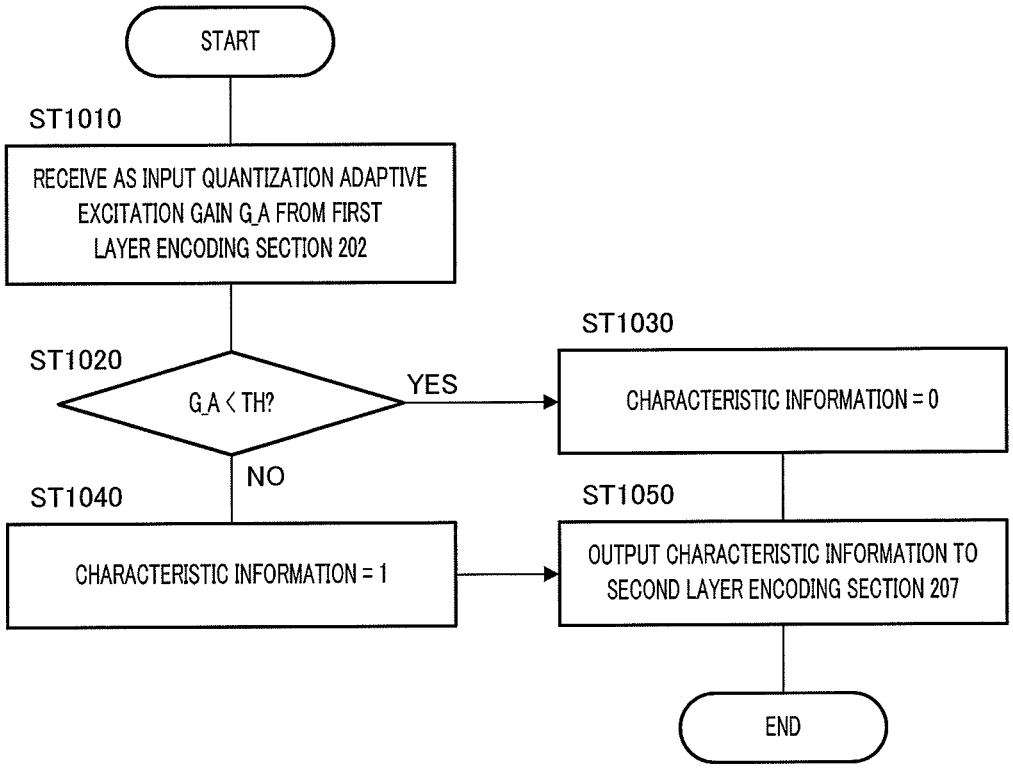
FIG. 6 is a flowchart showing the steps in the process of generating characteristic information in a characteristic deciding section shown in FIG. 3.

FIG. 6 is a flowchart showing the steps in the process of generating characteristic information in characteristic deciding section 206. Here, a step will be referred to as "ST" in the following explanation.

First, characteristic deciding section 206 receives as input quantization adaptive excitation gain G_A from parameter determining section 313 of first layer encoding section 202 (ST 1010). Next, characteristic deciding section 206 decides whether or not quantization adaptive excitation gain G_A is less than threshold TH (ST 1020). If it is decided that G_A is less than TH in ST 1020 ("YES" in ST 1020), characteristic deciding section 206 sets the characteristic information value to "0" (ST 1030). By contrast, if it is decided that G_A is equal to or greater than TH in ST 1020 ("NO" in ST 1020), characteristic deciding section 206 sets the characteristic information value to "1" (ST 1040). Thus, characteristic information uses the value "1" to show that the stability of the harmonic structure of an input spectrum is equal to or higher than a predetermined level, or uses the value "0" to show that the stability of the harmonic structure of an input spectrum is lower than a predetermined level. Next, characteristic deciding section 206 outputs the characteristic information to second layer encoding section 207 (ST 1050).

Here, the stability of the harmonic structure is a parameter showing the periodicity and amplitude variation of the spectrum (i.e. the levels of peaks and valleys). For example, when periodicity becomes clear or amplitude variation becomes large, the harmonic structure is stable.

Figure 7:
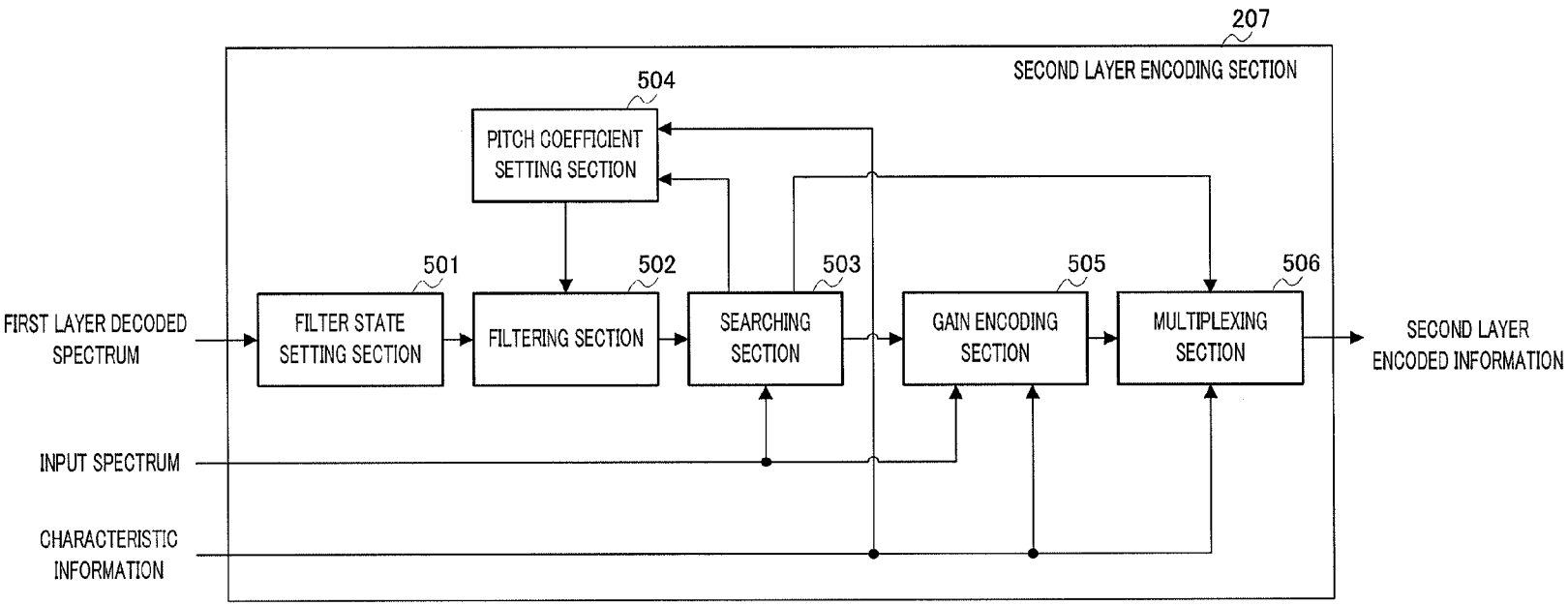
FIG. 7 is a block diagram showing the main components inside a second layer encoding section shown in FIG. 3.

FIG. 7 is a block diagram showing the main components inside second layer encoding section 207.

Second layer encoding section 207 is provided with filter state setting section 501, filtering section 502, searching section 503, pitch coefficient setting section 504, gain encoding section 505 and multiplexing section 506. These components perform the following operations.

Filter state setting section 501 sets first layer decoded spectrum S1(*k*) [0≦k<FL] received as input from orthogonal transform processing section 205, as a filter state used in filtering section 502. As the internal state of the filter (i.e. filter state), first layer decoded spectrum S1(*k*) is stored in the band 0≦k<FL of spectrum S(k) in the entire frequency band 0≦k<FH in filtering section 502.

Filtering section 502 has a multi-tap pitch filter (i.e. a filter having more than one tap), filters the first layer decoded spectrum based on the filter state set in filter state setting section 501 and the pitch coefficient received as input from pitch coefficient setting section 504, and calculates estimated value S2'(k) [FL≦k<FH] of the input spectrum (hereinafter "estimated spectrum"). Further, filtering section 502 outputs estimated spectrum S2'(k) to searching section 503. The filtering processing in filtering section 502 will be described later in detail.

Searching section 503 calculates the similarity between the higher band FL≦k<FH of input spectrum S2(*k*) received as input from orthogonal transform processing section 205 and estimated spectrum S2'(k) received as input from filtering section 502. The similarity is calculated by, for example, correlation calculations. Processing in filtering section 502, processing in searching section 503 and processing in pitch coefficient setting section 504 form a closed loop. In this closed loop, searching section 503 calculates the similarity for each pitch coefficient by variously changing the pitch coefficient T received as input from pitch coefficient setting section 504 to filtering section 502. Of these calculated similarities, searching section 503 outputs the pitch coefficient maximize the similarity, that is, optimal pitch coefficient T', to multiplexing section 506. Further, searching section 503 outputs estimated spectrum S2'(k) for optimal pitch coefficient T' to gain encoding section 505.

Pitch coefficient setting section 504 switches a search range for optimal pitch coefficient T' based on characteristic information received as input from characteristic deciding section 206. Further, pitch coefficient setting section 504 changes pitch coefficient T little by little in the search range under the control of searching section 503, and sequentially outputs pitch coefficient T to filtering section 502.

For example, pitch coefficient setting section 504 sets a search range from $T_{min}$ to $T_{max0}$ when the characteristic information value is "0," and sets a search range from $T_{min}$ to $T_{max1}$ when the characteristic information value is "1." Here, $T_{max0}$ is less than $T_{max1}$. That is, when the characteristic information value is "1," pitch coefficient setting section 504 increases the number of bits to allocate to pitch coefficient T by switching the search range for optimal pitch coefficient T' to a wider search range. Also, when the characteristic information value is "0," pitch coefficient setting section 504 decreases the number of bits to allocate to pitch coefficient T by switching the search range for optimal pitch coefficient T' to a narrower search range.

Gain encoding section 505 calculates gain information of the higher band FL≦k<FH of input spectrum S2(*k*) received as input from orthogonal transform processing section 205, based on characteristic information received as input from characteristic deciding section 206. To be more specific, gain encoding section 505 divides the frequency band FL≦k<FH into J subbands and calculates spectral power per subband of input spectrum S2(*k*). In this case, spectral power B(j) of the j-th subband is represented by following equation 9.

[9]

$$B(j) = \sum_{k=BL(j)}^{BH(j)} S2(k)^2 \quad \text{(Equation 9)}$$

In equation 9, BL(j) represents the lowest frequency in the j-th subband and BH(j) represents the highest frequency in the j-th subband. Further, similarly, gain encoding section 505 calculates spectral power B'(j) per subband of estimated spectrum S2'(k) received as input from searching section 503, according to following equation 10. Next, gain encoding section 505 calculates variation V(j) per subband of an estimated spectrum for input spectrum S2(*k*), according to following equation 11.

[10]

$$B'(j) = \sum_{k=BL(j)}^{BH(j)} S2'(k)^2 \quad \text{(Equation 10)}$$

[11]

$$V(j) = \sqrt{\frac{B(j)}{B'(j)}} \quad \text{(Equation 11)}$$

Further, gain encoding section 505 switches codebooks used in coding of variation V(j) according to the characteristic information value, encodes variation V(j) and outputs an index associated with encoded variation $V_q(j)$ to multiplexing section 506. Gain encoding section 505 switches a codebook to a codebook of the codebook size represented by "Size0" when the characteristic information value is "0," or switches a codebook to a codebook of the codebook size represented by "Size1" when the characteristic information value is "1," and encodes variation V(j). Here, Size1 is less than Size0. That is, when the characteristic information value is "0," gain encoding section 505 increases the number of bits to allocate for coding of gain variation V(j) by switching the codebook used to encode gain variation V(j) to a codebook of a larger size (i.e. a codebook with a larger number of entries of code vectors). Also, when the characteristic information value is "1," gain encoding section 505 decreases the number of bits to allocate to encode gain variation V(j) by switching the codebook used to encode gain variation V(j) to a codebook of a smaller size. Here, if the variation of the number of bits to allocate to gain variation V(j) in gain encoding section 505 is made equal to the variation of the number of bits to allocate to pitch coefficient T in pitch coefficient setting section 504, it is possible to fix the number of bits used in coding in second layer encoding section 207. For example, when the characteristic information value is "0," it is required to make the increment of bits to allocate to gain variation V(j) in gain encoding section 505 equal to the decrement of bits to allocate to pitch coefficient T in pitch coefficient setting section 504.

Multiplexing section 506 produces second layer encoded information by multiplexing optimal pitch coefficient T' received as input from searching section 503, the index of variation V(j) received as input from gain encoding section 505 and characteristic information received as input from characteristic deciding section 206, and outputs the result to encoded information multiplexing section 208. Here, it is equally possible to directly input T', V(j) and characteristic information in encoded information multiplexing section 208 and multiplex them with first layer encoded information in encoded information multiplexing section 208.

Figure 8:
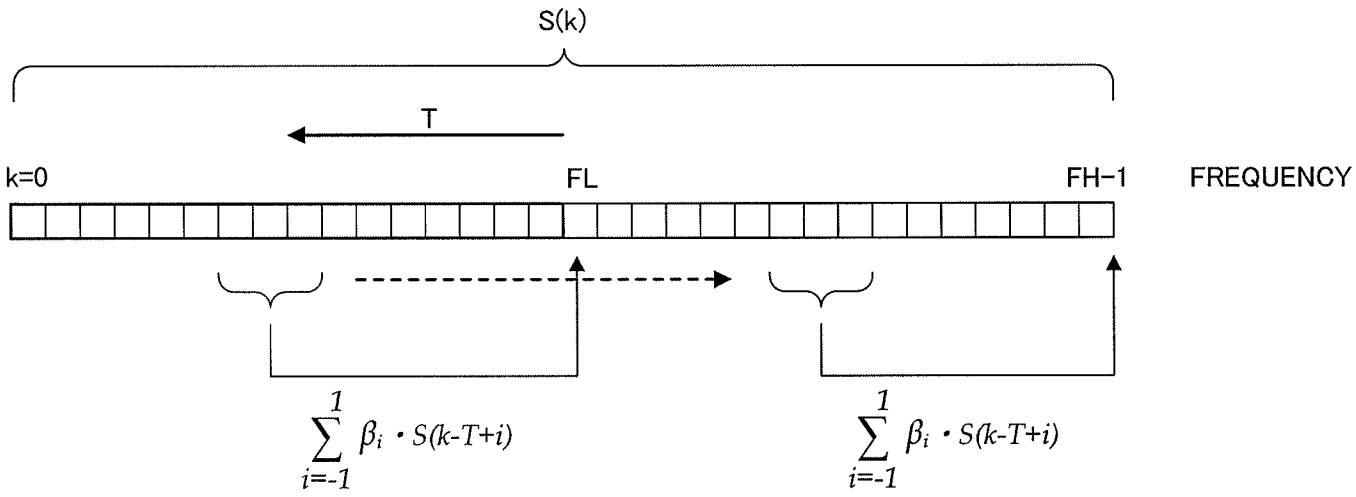
FIG. 8 illustrates specific filtering processing in a filtering section shown in FIG. 7.

Next, filtering processing in filtering section 502 will be explained in detail using FIG. 8.

Filtering section 502 generates the spectrum of the band FL≦k<FH using pitch coefficient T received as input from pitch coefficient setting section 504. The transfer function in filtering section 502 is represented by following equation 12.

[12]

$$P(z) = \frac{1}{1 - \sum_{i=-M}^{M} \beta_i z^{-T+i}} \quad \text{(Equation 12)}$$

In equation 12, T represents the pitch coefficients given from pitch coefficient setting section 504, and $\beta_i$ represents the filter coefficients stored inside in advance. For example, when the number of taps is three, the filter coefficient candidates are $(\beta_{-1}, \beta_0, \beta_1)=(0.1, 0.8, 0.2)$. In addition, the values $(\beta_{-1}, \beta_0, \beta_1)=(0.2, 0.6, 0.2)$ or $(0.3, 0.4, 0.3)$ are possible. Also, M is 1 in equation 12. Also, M represents the index related to the number of taps.

The band 0≦k<FL in spectrum S(k) of the entire frequency band in filtering section 502 stores first layer decoded spectrum S1(*k*) as the internal state of the filter (i.e. filter state).

The band FL≦k<FH of S(k) stores estimated spectrum S2'(k) by filtering processing of the following steps. That is, spectrum S(k−T) of a frequency that is lower than k by T, is basically assigned to S2'(k). Here, to improve the smoothing level of the spectrum, in fact, it is necessary to assign the sum of spectrums to S2'(k), where these spectrums are acquired by assigning all i's to spectrum $\beta_i \cdot S(k-T+i)$ multiplying predetermined filter coefficient $\beta_i$ by spectrum S(k−T+i), and where spectrum $\beta_i \cdot S(k-T+i)$ is a nearby spectrum separated by i from spectrum S(k−T). This processing is represented by following equation 5.

[13]

$$S2'(k) = \sum_{i=-1}^{1} \beta_i \cdot S2(k-T+i)^2 \quad \text{(Equation 13)}$$

By performing the above calculation by changing frequency k in the range FL≦k<FH in order from the lowest frequency FL, estimated spectrum S2'(k) in FL≦k<FH is calculated.

The above filtering processing is performed by zero-clearing S(k) in the range FL≦k<FH every time pitch coefficient T is given from pitch coefficient setting section 504. That is, S(k) is calculated and outputted to searching section 503 every time pitch coefficient T changes.

Figure 9:
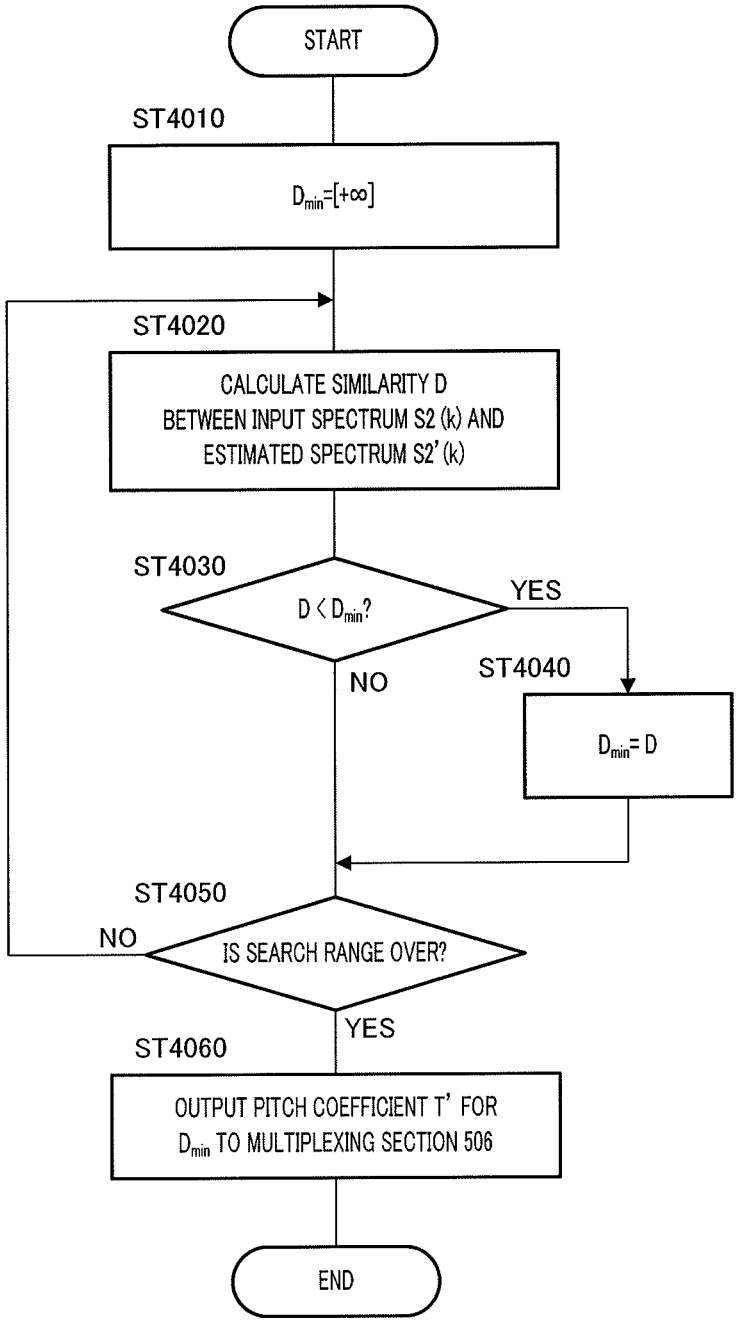
FIG. 9 is a flowchart showing the steps in the process of searching for optimal pitch coefficient T' in a searching section shown in FIG. 7.

Next, the steps in the process of searching for optimal pitch coefficient T' in searching section 502 will be explained using FIG. 9. FIG. 9 is a flowchart showing the steps in the process of searching for optimal pitch coefficient T' in searching section 503.

First, searching section 503 initializes minimum similarity $D_{min}$, which is a variable value for storing the minimum similarity value, to [+∞] (ST 4010). Next, according to following equation 14, searching section 503 calculates similarity D between the higher band FL≦k<FH of input spectrum S2(*k*) at a given pitch coefficient and estimated spectrum S2'(k) (ST 4020).

[14]

$$D = \sum_{k=0}^{M'} S2(k) \cdot S2(k) - \frac{\left(\sum_{k=0}^{M'} S2(k) \cdot S2'(k)\right)^2}{\sum_{k=0}^{M'} S2'(k) \cdot S2'(k)} \quad \text{(Equation 14)}$$

In equation 14, M' represents the number of samples upon calculating similarity D, and adopts an arbitrary value equal to or less than the sample length FH−FL+1 in the higher band.

Also, as described above, an estimated spectrum generated in filtering section 502 is the spectrum acquired by filtering the first layer decoded spectrum. Therefore, the similarity between the higher band FL≦k<FH of input spectrum S2(*k*) and estimated spectrum S2'(k) calculated in searching section 503 also shows the similarity between the higher band FL≦k<FH of input spectrum S2(*k*) and the first layer decoded spectrum.

Next, searching section 503 decides whether or not calculated similarity D is less than minimum similarity $D_{min}$ (ST 4030). If the similarity calculated in ST 4020 is less than minimum similarity $D_{min}$ ("YES" in ST 4030), searching section 503 assigns similarity D to minimum similarity $D_{min}$ (ST 4040). By contrast, if the similarity calculated in ST 4020 is equal to or greater than minimum similarity $D_{min}$ ("NO" in ST 4030), searching section 503 decides whether or not the search range is over. That is, with respect to all pitch coefficients in the search range, searching section 503 decides whether or not the similarity is calculated according to above equation 14 in ST 4020 (ST 4050). If the search range does not end ("NO" in ST 4050), the flow returns to ST 4020 again in searching section 503. Further, searching section 503 calculates the similarity according to equation 14, with respect to a different pitch coefficient from the pitch coefficient used when the similarity was previously calculated according to equation 14 in the step of ST 4020. By contrast, if the search range is over ("YES" in ST 4050), searching section 503 outputs pitch coefficient T associated with minimum similarity $D_{min}$ to multiplexing section 506 as optimal pitch coefficient T' (ST 4060).

Next, decoding apparatus 103 shown in FIG. 2 will be explained.

Figure 10:
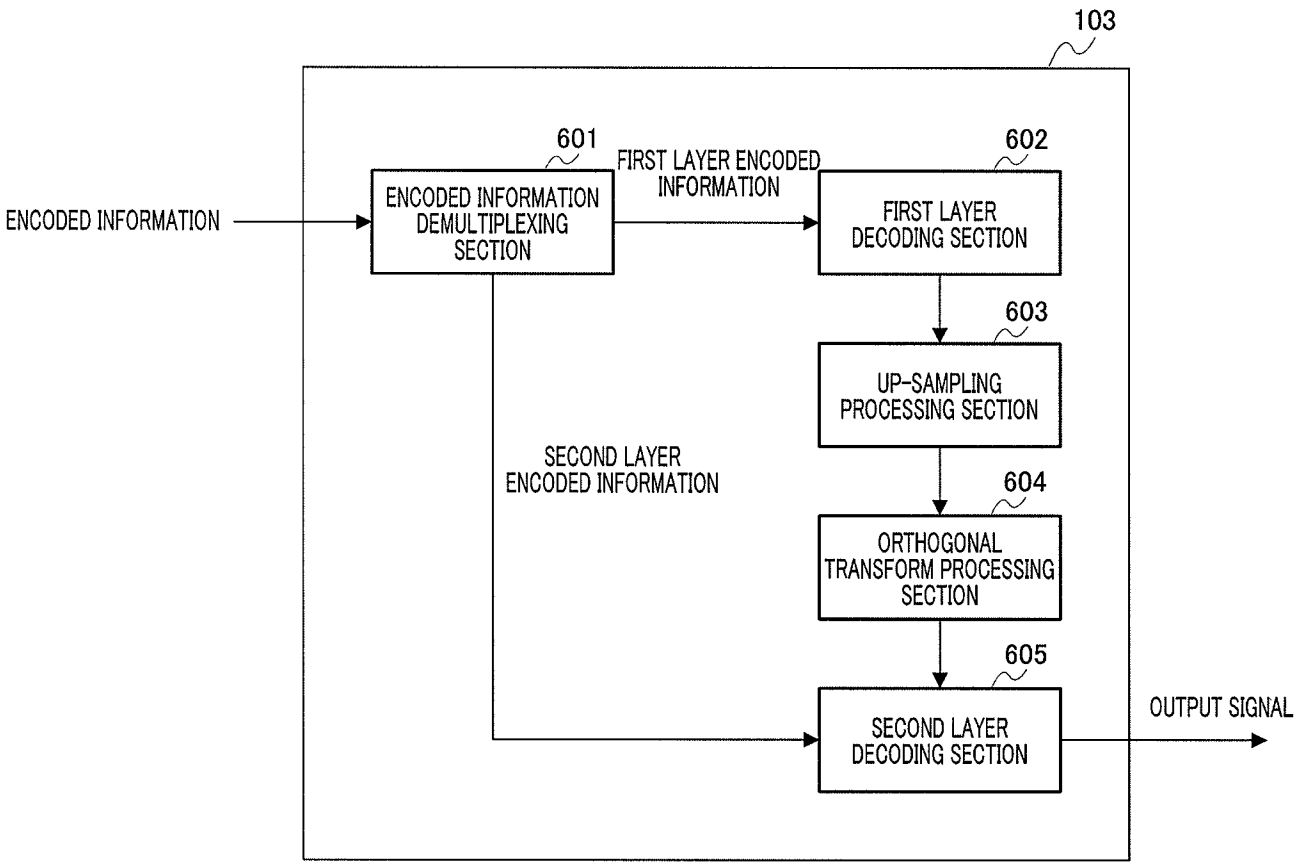
FIG. 10 is a block diagram showing the main components inside a decoding apparatus shown in FIG. 2.

FIG. 10 is a block diagram showing the main components inside decoding apparatus 103.

In FIG. 10, encoded information demultiplexing section 601 separates first layer encoded information and second layer encoded information from input encoded information, outputs the separated first layer encoded information to first layer decoding section 602 and outputs the separated second layer encoded information to second layer decoding section 605.

First layer decoding section 602 decodes the first layer encoded information received as input from encoded information demultiplexing section 601, and outputs a generated first layer decoded signal to up-sampling processing section 603. Here, the configuration and operations of first layer decoding section 602 are the same as in first layer decoding section 203 shown in FIG. 3, and therefore specific explanations will be omitted.

Up-sampling processing section 603 performs processing of up-sampling the sampling frequency of the first layer decoded signal received as input from first layer decoding section 602 from $SR_{base}$ to $SR_{input}$, and outputs the up-sampled first layer decoded signal acquired by the up-sampling processing to orthogonal transform processing section 604.

Orthogonal transform processing section 604 applies orthogonal transform processing (i.e. MDCT) to the up-sampled first layer decoded signal received as input from up-sampling processing section 603, and outputs MDCT coefficient S1($k$) of the resulting up-sampled first layer decoded signal (hereinafter "first layer decoded spectrum") to second layer decoding section 605. Here, the configuration and operations of orthogonal transform processing section 604 are the same as in orthogonal transform processing section 205, and therefore specific explanations will be omitted.

Second layer decoding section 605 generates a second layer decoded signal including higher-band components, from first layer decoded spectrum S1($k$) received as input from orthogonal transform processing section 604 and from second layer encoded information received as input from encoded information demultiplexing section 601, and outputs the second layer decoded signal as an output signal.

Figure 11:
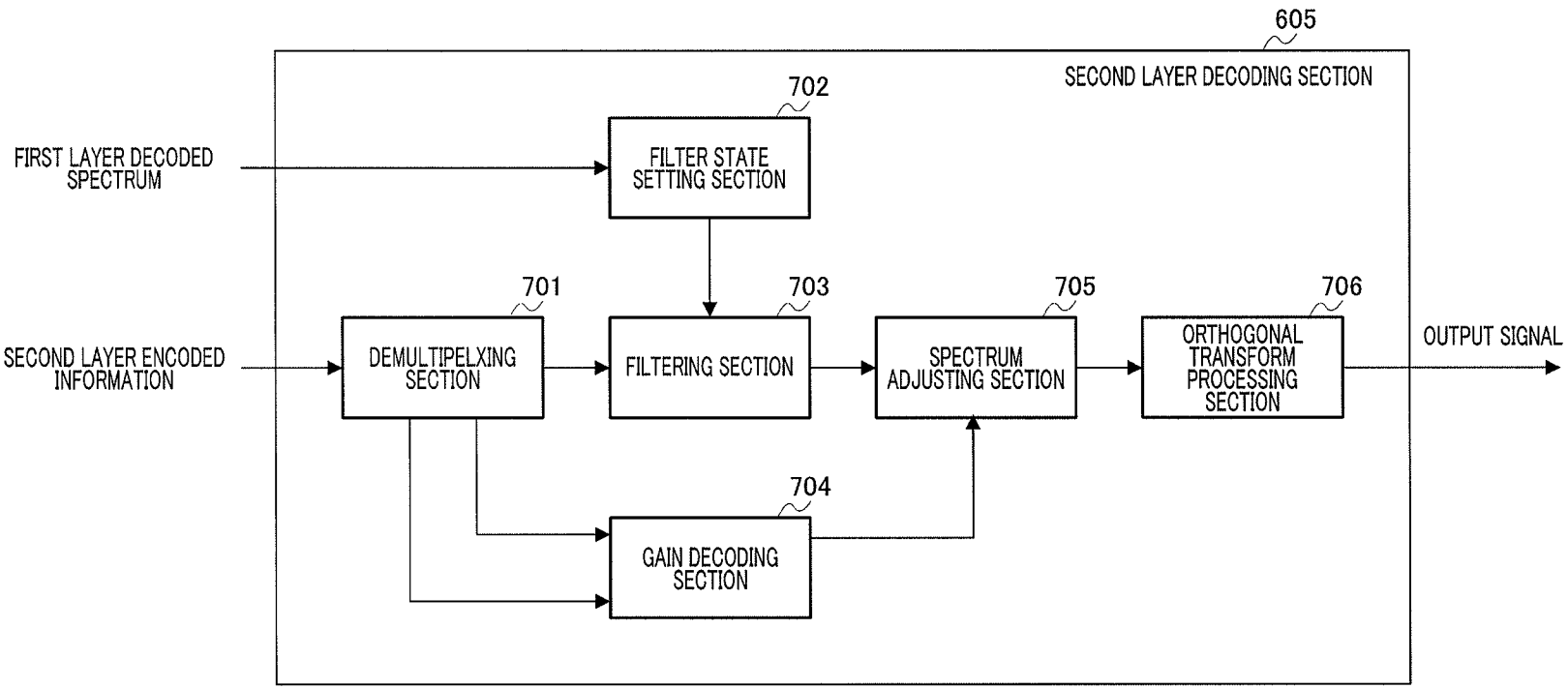
FIG. 11 is a block diagram showing the main components inside a second layer decoding section shown in FIG. 10.

FIG. 11 is a block diagram showing the main components inside second layer decoding section 605 shown in FIG. 10.

In FIG. 11, demultiplexing section 701 demultiplexes second layer encoded information received as input from encoded information demultiplexing section 601 into optimal pitch coefficient T', the index of encoded variation $V_q$(j) and the characteristic information, where optimal pitch coefficient T' is information related to filtering, encoded variation $V_q$(j) is information related to gains and the characteristic information is information related to the harmonic structure. Further, demultiplexing section 701 outputs optimal pitch coefficient T' to filtering section 703 and outputs the index of encoded variation $V_q$(j) and characteristic information to gain decoding section 704. Here, if optimal pitch coefficient T', the index of encoded variation $V_q$(j) and characteristic information have been separated in information demultiplexing section 601, it is not necessary to provide demultiplexing section 701.

Filter state setting section 702 sets first layer decoded spectrum S1($k$) [0≦k<FL] received as input from orthogonal transform processing section 604 to the filter state used in filtering section 703. Here, when the spectrum of the entire frequency band 0≦k<FH in filtering section 703 is referred to as "S(k)" for ease of explanation, first layer decoded spectrum S1($k$) is stored in the band 0≦k<FL of S(k) as the internal state (filter state) of the filter. Here, the configuration and operations of filter state setting section 702 are the same as in filter state setting section 501, and therefore specific explanations will be omitted.

Filtering section 703 has a multi-tap pitch filter (i.e. a filter having more than one tap). Further, filtering section 703 filters first layer decoded spectrum S1($k$) based on the filter state set in filter state setting section 702, optimal pitch coefficient T' received as input from demultiplexing section 701 and filter coefficients stored inside in advance, and calculates estimated spectrum S2'(k) of input spectrum S2($k$) as shown in above equation 13. Even in filtering section 703, the filter function shown in above equation 12 is used.

Gain decoding section 704 decodes the index of encoded variation $V_q$(j) using the characteristic information received as input from demultiplexing section 701, and calculates variation $V_q$(j) representing the quantized value of variation V(j). Here, gain decoding section 704 switches codebooks used in decoding of the index of encoded variation $V_q$(j) according to the characteristic information value. The method of switching codebooks in gain decoding section 704 is the same as the method of switching codebooks in gain encoding section 505. That is, gain decoding section 704 switches the codebook of the codebook size represented by "Size0" when the characteristic information value is "0," or switches the codebook of the codebook size represented by "Size 1" when the characteristic information value is "1." Even in this case, Size1 is less than Size0.

According to following equation 15, spectrum adjusting section 705 multiplies estimated spectrum S2'(k) received as input from filtering section 703 by variation $V_q$(j) per subband received as input from gain decoding section 704. By this means, spectrum adjusting section 705 adjusts the spectral shape in the frequency band FL≦k<FH of estimated spectrum S2'(k), and generates and outputs second layer decoded spectrum S3($k$) to orthogonal transform processing section 706.

[15]

$$S3(k)=S2'(k)\cdot V_q(j)\ (BL(j)\leqq k\leqq BH(j),\ \text{for all}\ j) \qquad \text{(Equation 15)}$$

Here, the lower band 0≦k<FL of second layer decoded spectrum S3($k$) is comprised of first layer decoded spectrum S1($k$), and the higher band FL≦k<FH of second layer decoded spectrum S3($k$) is comprised of estimated spectrum S2'(k) with the adjusted spectral shape.

Orthogonal transform processing section 706 transforms second layer decoded spectrum S3($k$) received as input from spectrum adjusting section 705 into a time domain signal, and outputs the resulting second layer decoded signal as an output signal. Here, suitable processing such as windowing, overlapping and addition is performed where necessary, for preventing discontinuities from occurring between frames.

The specific processing in orthogonal transform processing section 706 will be explained below.

Orthogonal transform processing section 706 incorporates buffer buf'(k) and initializes it as shown in following equation 16.

[16]

$$buf'(k)=0\ (k=0,\ldots,N-1) \qquad \text{(Equation 16)}$$

Also, using second layer decoded spectrum S3($k$) received as input from spectrum adjusting section 705, orthogonal transform processing section 706 calculates second layer decoded signal $y''_n$ according to following equation 17.

[17]

$$y''_n=\frac{2}{N}\sum_{n=0}^{2N-1} Z5(k)\cos\left[\frac{(2n+1+N)(2k+1)\pi}{4N}\right] \qquad \text{(Equation 17)}$$

$$(n=0,\ldots,N-1)$$

In equation 17, Z5($k$) represents a vector combining decoded spectrum S3($k$) and buffer buf'(k) as shown in following equation 18.

[18]

$$Z5(k) = \begin{cases} buf'(k) & (k = 0, \ldots N-1) \\ S3(k) & (k = N, \ldots 2N-1) \end{cases} \quad \text{(Equation 18)}$$

Next, orthogonal transform processing section 706 updates buffer buf'(k) according to following equation 19.

[19]

$$buf'(k)=S4(k)\ (k=0, \ldots, N-1) \quad \text{(Equation 19)}$$

Next, orthogonal transform processing section 706 outputs decoded signal $y''_n$ as an output signal.

Thus, according to the present embodiment, in coding/decoding of performing band expansion using the lower-band spectrum and estimating the higher-band spectrum, an encoding apparatus analyzes the stability of the harmonic structure of an input spectrum using a quantization adaptive excitation gain and adequately changes bit allocation between coding parameters according to the analysis result, so that it is possible to improve the sound quality of decoded signals acquired in a decoding apparatus.

To be more specific, an encoding apparatus according to the present embodiment decides that the harmonic structure of an input spectrum is relatively stable when a quantization adaptive excitation gain is equal to or greater than a threshold, or decides that the harmonic structure of the input spectrum is relatively unstable when the quantization adaptive excitation gain is less than the threshold. Here, in the former case, while the number of bits for searching for an optimal pitch coefficient used in filtering for band expansion is increased, the number of bits for encoding information related to gains is decreased. Also, in the latter case, while the number of bits for searching for an optimal pitch coefficient used in filtering for band expansion is decreased, the number of bits for encoding information related to gains is increased. By this means, it is possible to perform coding with suitable bit allocation based on the harmonic structure of an input spectrum, and improve the sound quality of decoded signals in a decoding apparatus.

Also, an example case has been described above with the present embodiment where characteristic deciding section 206 generates characteristic information using a quantized adaptive excitation gain. However, the present invention is not limited to this, and characteristic deciding section 206 can determine characteristic information using other parameters included in first layer encoded information such as an adaptive excitation vector. Also, the number of parameters to use to determine characteristic information is not limited to one, and it is equally possible to use a plurality of or all the parameters included in first layer encoded information.

Also, an example case has been described above with the present embodiment where characteristic deciding section 206 generates characteristic information using a quantization adaptive excitation gain included in first layer encoded information. However, the present invention is not limited to this, and characteristic deciding section 206 can analyze the stability of the harmonic structure of an input spectrum directly and generates characteristic information. As a method of analyzing the stability of the harmonic structure of an input spectrum, for example, there is a method of calculating the energy variation per frame of an input signal.

Figure 12:
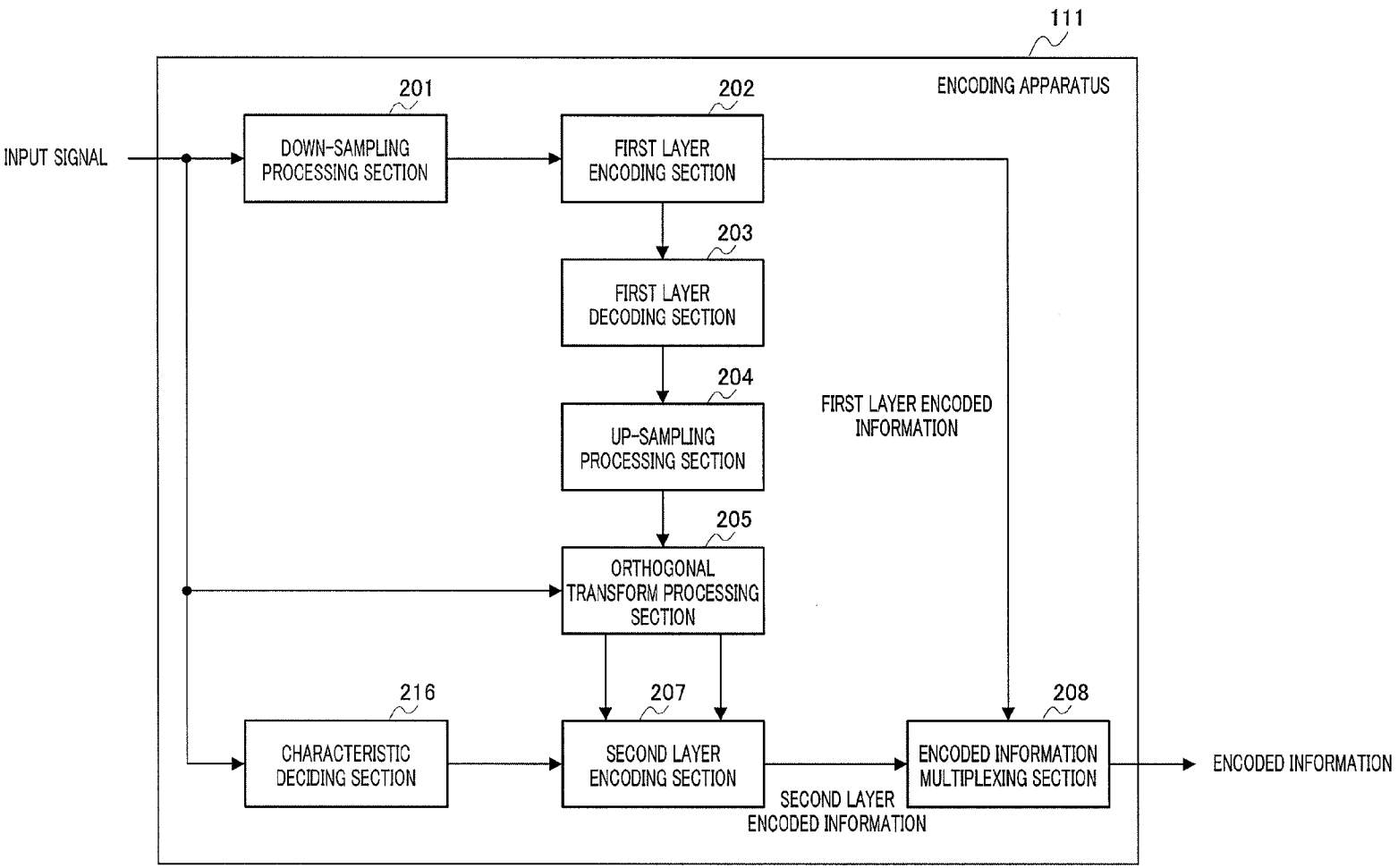
FIG. 12 is a block diagram showing the main components inside a variation of an encoding apparatus shown in FIG. 3.
Figure 13:
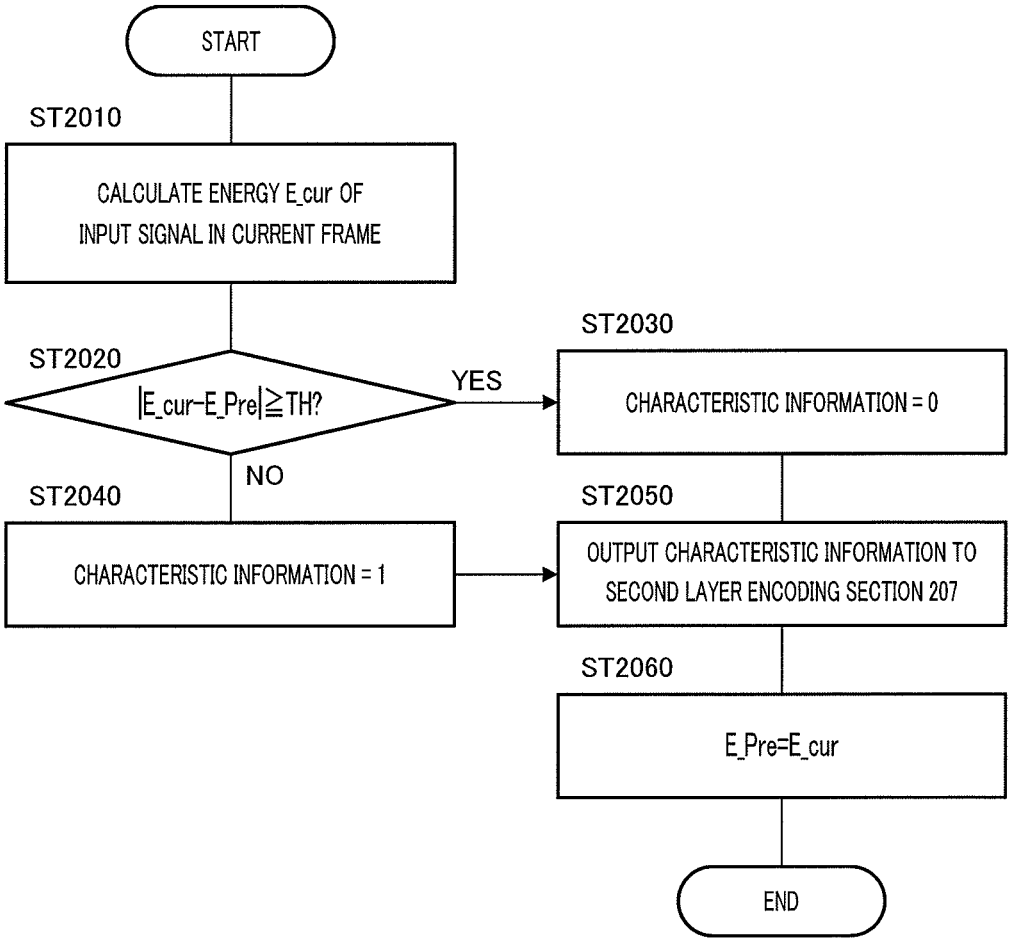
FIG. 13 is a flowchart showing the steps in the process of generating characteristic information in a characteristic deciding section shown in FIG. 12.

This method will be explained below using FIG. 12 and FIG. 13. FIG. 12 is a block diagram showing main components inside encoding apparatus that generate characteristic information according to the energy variation. Encoding apparatus 111 differs from encoding apparatus 101 shown in FIG. 3 in providing characteristic deciding section 216 instead of characteristic deciding section 206. In FIG. 12, an input signal is directly received as input in characteristic deciding section 216. FIG. 13 is a flowchart showing the steps in the process of generating characteristic information in characteristic deciding section 216. First, characteristic deciding section 216 calculates energy E_cur of the current frame of an input signal (ST 2010). Next, characteristic deciding section 216 decides whether or not absolute value |E_cur−E_Pre| of the difference between energy E_cur of the current frame and energy E_Pre of the previous frame is equal to or greater than threshold TH (ST 2020). Characteristic deciding section 216 sets the characteristic information value to "0" (ST 2030) if |E_cur−E_Pre| is equal to or greater than TH ("YES" in ST 2020), or sets the characteristic information value to "1" (ST 2040) if |E_cur−E_Pre| is less than TH ("NO" in ST 2020). Next, characteristic deciding section 216 outputs characteristic information to second layer encoding section 207 (ST 2050) and updates energy E_Pre of the previous frame using energy E_cur of the current frame (ST 2060). Here, characteristic deciding section 216 stores the energy of several past frames, and it is possible to use the energy to calculate the energy variation of the current frame to the past frames.

Also, a case has been described above with the present embodiment where bit allocation is changed depending on input signal characteristics by changing the size of a setting range of pitch coefficients (i.e. the number of entries) in pitch coefficient setting section 504 of second layer encoding section 207 according to a second threshold and further changing the size of a codebook size (i.e. the number of entries) upon coding in gain encoding section 505. For example, one embodiment sets a number of search candidates to a value greater than the second threshold when the quantization adaptive excitation gain is equal to or greater than the threshold TH, or sets the number of search candidates to a value less than the second threshold when the quantization adaptive excitation gain is less than the threshold TH, and further sets a pitch coefficient used in the filtering section filter by changing the pitch coefficient according to the number of search candidates. However, the preset invention is not limited to this, and is equally applicable to a case where coding processing is changed by other methods than a simple method of changing the range of pitch coefficients and the codebook size. For example, as for the method of setting pitch coefficients, it is possible to switch the setting range of pitch coefficients in an irregular manner, instead of switching between "Tmin to Tmax0" and "Tmin to Tmax1" in a simple manner. That is, it is possible to perform a search in the range from Tmin to Tmax0(where the number of entries is Tmax0−Tmin) when the characteristic information value is "0," and perform a search in the range from Tmin to Tmax2 every k entries (the number of entries is Tmax1−Tmin) when the characteristic information value is "1." Here, the above-described conditions are applied to the number of entries. Thus, not only by changing the number of entries of pitch coefficients simply and regularly but also by changing pitch coefficients irregularly with the condition that the number of entries is Tmax1−Tmin, it is possible to adopt a method of setting pitch coefficients better in accordance with input signal characteristics. Compared to the setting method described in the present embodiment, this setting method enables a similarity search over a wide range of the lower band of an input signal, and is therefore effective especially in the case where the spectrum characteristic of an input signal varies significantly over the lower band.

Also, as for the codebook size, in addition to the method of switching between a codebook of the codebook size represented by "Size0" and a codebook of the codebook size represented by "Size1" in a simple manner, the method of changing the configuration of gains to be encoded is equally possible. For example, when the characteristic information value is "0," gain encoding section 505 divides the frequency band FL≦k<FH into K subbands, instead of J subbands (K>J), and can encode the gain variation in each subband. Here, assume that the gain variation in K subbands is encoded using the amount of information required when the above codebook size is "Size0." Thus, by encoding gain variation on the conditions that the subband bandwidth is narrowed and the number of subbands is increased, instead of changing the codebook size in a simple manner upon encoding gain variation, it is possible to encode gains better in accordance with an input signal characteristic. With this method, by changing the number of subbands in the higher-band gain, it is possible to improve resolution of the gain on the frequency axis, and this method is effective especially when the power of the higher-band spectrum of an input signal varies significantly on the frequency axis.

Embodiment 2

An example case has been described with Embodiment 1 of the present invention where characteristic information is generated using time domain signals or encoded information. By contrast with this, in Embodiment 2 of the present invention, a case will be described using FIG. 14 and FIG. 15 where characteristic information is generated by converting an input signal into the frequency domain and analyzing the stability of the harmonic structure.

A communication system according to the present embodiment and the communication system according to Embodiment 1 of the present invention are similar, and are different only in providing encoding apparatus 121 instead of encoding apparatus 101.

Figure 14:
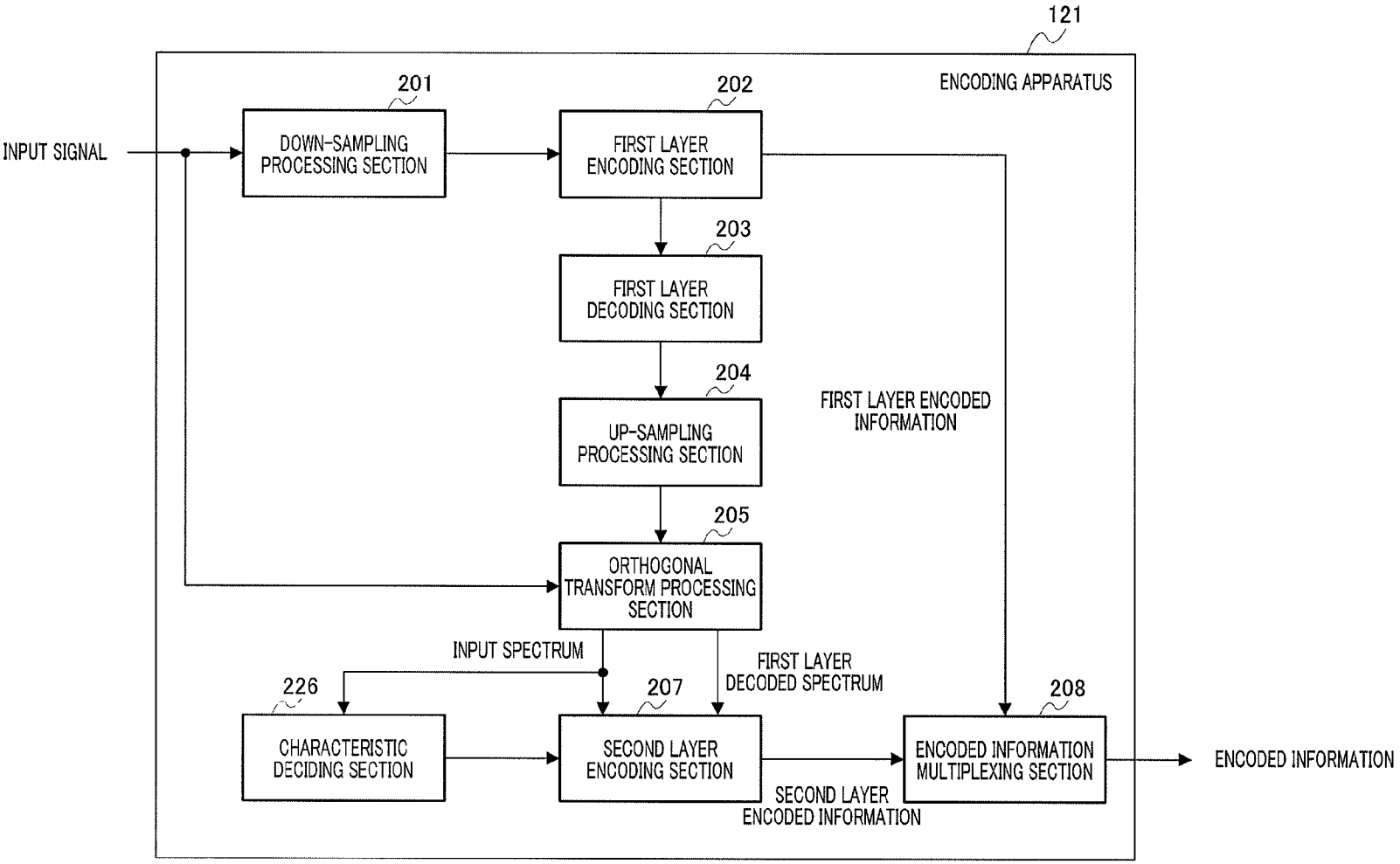
FIG. 14 is a block diagram showing the main components inside an encoding apparatus according to Embodiment 2 of the present invention.

FIG. 14 is a block diagram showing the main components inside encoding apparatus 121 according to Embodiment 2 of the present invention. Here, encoding apparatus 121 shown in FIG. 14 and encoding apparatus 101 shown in FIG. 3 are basically the same, but are different only in providing characteristic deciding section 226 instead of characteristic deciding section 206.

Characteristic deciding section 226 analyzes the stability of the harmonic structure of an input spectrum received as input from orthogonal transform section 205, generates characteristic information based on this analysis result and outputs the characteristic information to second layer encoding section 207. Here, an example case will be explained where the spectral flatness measure ("SFM") is used as the harmonic structure of the input spectrum. SFM is represented by the ratio between the geometric mean and arithmetic mean (=geometric mean/arithmetic mean) of an amplitude spectrum. SFM approaches 0.0 when the peak level of the spectrum becomes higher or approaches 1.0 when the noise level of the spectrum becomes higher. Characteristic deciding section 226 calculates SFM of an input signal spectrum and generates characteristic information H by comparing SFM and predetermined threshold $SFM_{th}$ as shown in following equation 20.

[20]

$$H = \begin{cases} 0 & (\text{if } SFM \geq SFM_{th}) \\ 1 & (\text{else}) \end{cases} \quad \text{(Equation 20)}$$

Figure 15:
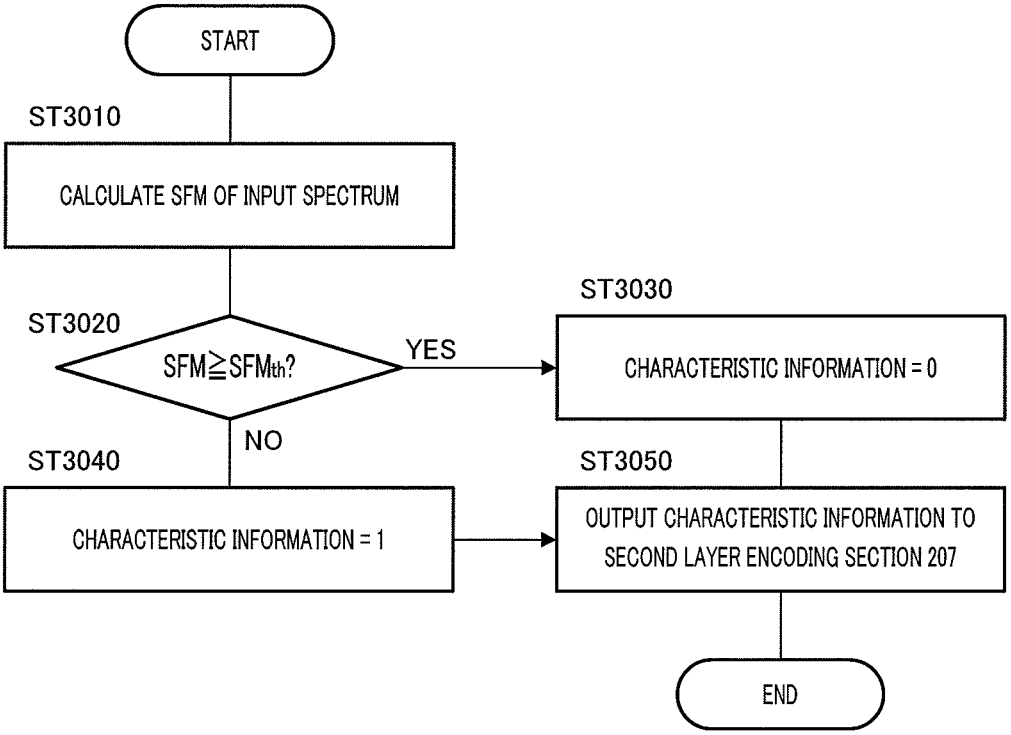
FIG. 15 is a flowchart showing the steps in the process of generating characteristic information in a characteristic deciding section shown in FIG. 14.

FIG. 15 is a flowchart showing the steps in the process of generating characteristic information in characteristic deciding section 226.

First, characteristic deciding section 226 calculates SFM as a result of analyzing the stability of the harmonic structure of an input spectrum (ST 3010). Next, characteristic deciding section 226 decides whether or not the SFM of the input spectrum is equal to or greater than threshold $SFM_{th}$ (ST 3020). The value of characteristic information H is set to "0" (ST 3030) if the SFM of the input spectrum is equal to or greater than $SFM_{th}$ ("YES" in ST 3020), or the value of characteristic information H is set to "1" (ST 3040) if the SFM of the input spectrum is less than $SFM_{th}$ ("NO" in ST 3020). Next, characteristic deciding section 226 outputs characteristic information to second layer encoding section 207 (ST 3050).

Thus, according to the present embodiment, in coding/decoding of performing band expansion using the lower-band spectrum and estimating the higher-band spectrum, an encoding apparatus analyzes the stability of the harmonic structure of an input spectrum acquired by converting an input signal into the frequency domain and changes bit allocation between coding parameters according to the analysis result. Therefore, it is possible to improve the sound quality of decoded signals acquired in a decoding apparatus Also, an example case has been described above with the present embodiment where characteristic information is generated using SFM as the harmonic structure of an input spectrum. However, the present invention is not limited to this, and it is equally possible to use other parameters as the harmonic structure of an input spectrum. For example, when characteristic deciding section 226 counts the number of peaks with amplitude equal to or greater than a predetermined threshold in an input spectrum (in this case, if the input spectrum is consecutively equal to or greater than the threshold, the consecutive part is counted as one peak), and when the counted number is less than a predetermined number, characteristic deciding section 226 decides that the harmonic structure is stable (i.e. the value of characteristic information is set to "1"). Here, there is no problem to reverse the value of characteristic information H between a case where the number of peaks is equal to or greater than a threshold and a case where the number of peaks is less than the threshold. Also, characteristic deciding section 226 may filter an input spectrum by a comb filter utilizing a pitch period calculated in first layer encoding section 202, calculate the energy per frequency band and decide that the harmonic structure is stable when the calculated energy is equal to or greater than a predetermined threshold. Also, characteristic deciding section 226 may analyze the harmonic structure of an input spectrum utilizing a dynamic range and generate characteristic information. Also, characteristic deciding section 226 may calculate the tonality (i.e. harmonic level) of an input spectrum and change coding processing in second layer encoding section 207 according to the calculated tonality. Tonality is disclosed in MPEG-2 AAC (ISO/IEC 13818-7), and therefore explanation will be omitted.

Also, an example case has been described above with the present embodiment where characteristic information is generated per processing frame for an input spectrum. However, the present invention is not limited to this, and it is equally possible to generate characteristic information per subband of an input spectrum. That is, characteristic deciding section 226 can evaluate the stability of the harmonic structure per subband of an input spectrum and generate characteristic information. Here, subbands in which the stability of the harmonic structure is evaluated may or may not adopt the same configuration as subbands in gain encoding section 505 and gain decoding section 704. Thus, by analyzing the harmonic structure per subband and changing band expansion processing in second layer encoding section 207 according to this analysis result, it is possible to encode an input signal more efficiently.

Embodiments of the present invention have been described above.

Also, example cases have been described with the above embodiments where, when searching section 503 searches for a similar part between the higher band of an input spectrum, S2(*k*) (FL≦k<FH), and estimated spectrum S2'(k), that is, when searching section 503 searches for optimal pitch coefficient T', the entire part of each spectrum is searched by switching the search range according to the characteristic information value. However, the present invention is not limited to this, and it is equally possible to search only the part of each spectrum such as the head part, by switching the search range according to the characteristic information value.

Also, although example cases have been described with the above embodiments where codebooks are switched using characteristic information in a gain decoding section, it is equally possible to perform decoding without using characteristic information and switching codebooks.

Also, example cases have been described with the above embodiments where "0" and "1" are used as characteristic information values. However, the present invention is not limited to this, and it is equally possible to provide two or more thresholds to be compared with the stability of the harmonic structure, and set three or more kinds of characteristic information values. In this case, searching section 503, gain encoding section 505 and gain decoding section 704 each provide three or more kinds of search ranges and three or more kinds of codebooks of different codebook sizes, and adequately switch these search ranges or codebooks according to characteristic information.

Also, example cases have been described with the above embodiments where searching section 503, gain encoding section 505 and gain decoding section 704 each switch search ranges or codebooks according to the characteristic information value and change the number of bits to allocate to encode pitch coefficients or gains. However, the present invention is not limited to this, and it is equally possible to change the number of bits to allocate to coding parameters other than pitch coefficients or gains, according to the characteristic information value.

Also, example cases have been described with the above embodiments where search ranges in which optimal pitch coefficient T' is searched for are switched according to the stability of the harmonic structure of an input spectrum. However, the present invention is not limited to this, and, when the harmonic structure of an input spectrum is equal to or less than a predetermined level, in searching section 503, it is equally possible to always select a pitch coefficient in a fixed manner without searching for optimal pitch coefficient T', while allocating a larger number of bits for gain coding. This is because, when an adaptive excitation gain is quite small, the pitch level of the lower band spectrum of an input spectrum is quite low, and it is possible to further improve the overall accuracy of coding by using more bits for encoding a gain of the higher band spectrum than by using more bits for searching for an adaptive pitch coefficient in searching section 503.

Also, example cases have been described with the above embodiments where gain encoding section 505 and gain decoding section 704 switch between a plurality of codebooks of different codebooks. However, the present invention is not limited to this, and, with a single codebook, it is equally possible to switch only the numbers of entries used in coding. By this means, it is possible to reduce the memory capacity required in an encoding apparatus and decoding apparatus. Further, in this case, if the arrangement order of codes stored in the single codebook is associated with the numbers of entries used, it is possible to perform coding more efficiently.

Also, example cases have been described with the above embodiments where first layer encoding section 202 and first layer decoding section 203 perform speech coding/decoding with a CELP scheme.

However, the present invention is not limited to this, and first layer encoding section 202 and first layer decoding section 203 can equally perform speech coding/decoding with other schemes than the CELP scheme.

Also, the threshold, the level and the number of peaks used for comparison may be a fixed value or a variable value set adequately with conditions, that is, an essential requirement is that their values are set before comparison is performed.

Also, although the decoding apparatus according to the above embodiments perform processing using bit streams transmitted from the encoding apparatus according the above embodiments, the present invention is not limited to this, and it is equally possible to perform processing with bit streams that are not transmitted from the encoding apparatus according to the above embodiments as long as these bit streams include essential parameters and data.

Also, the present invention is applicable even to a case where a signal processing program is operated after being recorded or written in a computer-readable recording medium such as a memory, disk, tape, CD, and DVD, so that it is possible to provide operations and effects similar to those of the present embodiment.

Although cases have been described with the above embodiments as an example where the present invention is implemented with hardware, the present invention can be implemented with software.

Furthermore, each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be regenerated is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2007-330838, filed on Dec. 21, 2007, and Japanese Patent Application No. 2008-129710, filed on May 16, 2008, including the specifications, drawings and abstracts, are incorporated herein by reference in their entireties.

INDUSTRIAL APPLICABILITY

The encoding apparatus, decoding apparatus and encoding method according to the present invention can improve the quality of decoded signals upon performing band expansion using the lower band spectrum and estimating the higher band spectrum, and are applicable to, for example, a packet communication system, mobile communication system, and so on.

The invention claimed is:

1. An encoding apparatus comprising:

a first encoder that encodes an input signal and generates first encoded information;

a decoder that decodes the first encoded information and generates a decoded signal;

a characteristic deciding processor that analyzes a stability of a harmonic structure of the input signal and generates harmonic characteristic information showing an analysis result; and a second encoder that generates second encoded information by encoding a difference of the decoded signal with respect to the input signal, and, based on the harmonic characteristic information, changes a number of bits to allocate to a plurality of parameters forming the second encoded information, wherein the second encoder comprises a gain encoder that encodes a gain of the input final using a gain codebook comprising a plurality of code vectors; and the gain encoder decreases a number of code vectors used to encode the gain when the harmonic characteristic information is equal to or greater than a first threshold, or increases the number of code vectors used to encode the gain when the harmonic characteristic information is less than the first threshold.

2. The encoding apparatus according to claim 1, wherein:

the first encoder performs speech coding with a code excited linear prediction scheme, and generates the first encoded information including a quantization adaptive excitation gain; and the characteristic deciding processor generates the harmonic characteristic information of different values, depending on whether or not the quantization adaptive excitation gain is equal to or greater than a third threshold.

3. The encoding apparatus according to claim 2, wherein the second encoder comprises:

a filter that filters the first decoded signal, which is a signal of a band equal to or lower than a predetermined frequency, and generates an estimation signal, which is a signal estimating a band of the input signal higher than the predetermined frequency;

a setter that sets a wider search range when the quantization adaptive excitation gain is equal to or greater than the first threshold, or sets a narrower search range when the quantization adaptive excitation gain is less than the first threshold, and sets a pitch coefficient used in the filter by changing the pitch coefficient in the search range; and a searcher that searches for the pitch coefficient when a similarity is smallest between the higher band of the input signal and one of the lower band of the input signal and the estimation signal.

4. The encoding apparatus according to claim 2, wherein the second encoder comprises:

a filter that filters the first decoded signal, which is a signal of a band equal to or lower than a predetermined frequency, and generates an estimation signal, which is a signal estimating a band of the input signal higher than the predetermined frequency;

a setter that sets a number of search candidates to a value greater than a second threshold when the quantization adaptive excitation gain is equal to or greater than the first threshold, or sets the number of search candidates to a value less than the second threshold when the quantization adaptive excitation gain is less than the first threshold, and sets a pitch coefficient used in the filter by changing the pitch coefficient according to the number of search candidates; and a searcher that searches for the pitch coefficient when a similarity is smallest between the higher band of the input signal and one of the lower band of the input signal and the estimation signal.

5. The encoding apparatus according to claim 2, wherein:

the gain encoder decreases a number of code vectors used to encode the gain when the quantization adaptive excitation gain is equal to or greater than the first threshold, or increases the number of code vectors used to encode the gain when the quantization adaptive excitation gain is less than the first threshold.

6. The encoding apparatus according to claim 2, wherein:

the gain encoder decreases a number of subbands used to encode the gain when the quantization adaptive excitation gain is equal to or greater than the first threshold, or increases the number of subbands used to encode the gain when the quantization adaptive excitation gain is less than the first threshold.

7. The encoding apparatus according to claim 5, wherein the gain encoder comprises a plurality of gain codebooks of different sizes and the gain encoder changes the number of code vectors used to encode the gain by switching the gain codebooks used to encode the gain.

8. The encoding apparatus according to claim 5, wherein the gain encoder comprises one gain codebook and the gain encoder changes the number of code vectors used to encode the gain in a plurality of code vectors forming the one gain codebook.

9. The encoding apparatus according to claim 1, wherein the characteristic deciding processor calculates an energy variation of a current frame with respect to a previous frame of the input signal, and generates the harmonic characteristic information of different values depending on whether or not the variation is equal to or greater than a fourth threshold.

10. The encoding apparatus according to claim 1, further comprising a transformer that transforms the input signal into a frequency domain and generates a frequency domain spectrum, wherein the characteristic deciding processor analyzes the stability of the harmonic structure of the input signal using the frequency domain spectrum.

11. The encoding apparatus according to claim 10, wherein:

the transformer performs orthogonal transform processing of the input signal and calculates an orthogonal transform coefficient as the frequency domain spectrum; and the characteristic deciding processor calculates a spectrum flatness measure of the orthogonal transform coefficient and generates the harmonic characteristic information of different values depending on whether or not the spectral flatness measure is equal to or greater than a fifth threshold.

12. The encoding apparatus according to claim 10, wherein:

the transformer performs orthogonal transform processing of the input signal and calculates an orthogonal transform coefficient as the frequency domain spectrum; and the characteristic deciding processor generates the harmonic characteristic information of different values, depending on whether or not a number of peaks with an amplitude equal to or greater than a predetermined level is equal to or greater than a predetermined number in the orthogonal transform coefficient.

13. A decoding apparatus comprising:

a receiver that receives first encoded information acquired by encoding an input signal in an encoding apparatus, second encoded information acquired by encoding a difference between the input signal and a decoded signal that comprises a decoding of the first encoded information, and harmonic characteristic information generated based on an analysis result of analyzing a stability of a harmonic structure of the input signal;

a first decoder that decodes a first layer using the first encoded information and acquires a first decoded signal; and a second decoder that decodes a second layer using the second encoded information and the first decoded signal, and acquires a second decoded signal, at least one of the receiver, first encoder and second encoder comprises a processor;

wherein the second decoder performs decoding in the second layer using a plurality of parameters which form the second encoded information and to which a number of bits is allocated based on the harmonic characteristic information in the encoding apparatus, wherein the second decoder comprises a gain decoder that decodes a gain from the second encoded information using a gain codebook comprised of a plurality of code vectors; and the gain decoder decreases a number of code vectors used to decode the gain when the harmonic characteristic information is equal to or greater than a first threshold, or increases the number of code vectors used to decode the gain when the harmonic characteristic information is less than the first threshold.

14. An encoding method, performed by a processor, comprising:

encoding, by the processor, an input audio signal and generating first encoded information;

decoding, by the processor, the first encoded information and generating a decoded audio signal;

analyzing, by the processor, a stability of a harmonic structure of the input audio signal and generating harmonic characteristic information showing a result of the analysis; and generating, by the processor, second encoded information by encoding a difference of the decoded audio signal with respect to the input audio signal, and, based on the harmonic characteristic information, changing a number of bits to allocate to a plurality of parameters forming the second encoded information, wherein generating second encoded information comprises encoding gain information by encoding a gain of the input signal using a gain codebook comprised of a plurality of code vectors; and encoding gain information decreases a number of code vectors used to encode the gain when the harmonic characteristic information is equal to or greater than a first threshold or increases the number of code vectors used to encode the gain when the harmonic characteristic information is less than the first threshold.

* * * * *